US011208225B2

(12) United States Patent
Mitchell et al.

(10) Patent No.: US 11,208,225 B2
(45) Date of Patent: Dec. 28, 2021

(54) STRETCH WRAPPING MACHINE WITH CURVE FIT CONTROL OF DISPENSE RATE

(71) Applicant: Lantech.com, LLC, Louisville, KY (US)

(72) Inventors: Michael P. Mitchell, Louisville, KY (US); Patrick R. Lancaster, III, Louisville, KY (US)

(73) Assignee: LANTECH.COM, LLC, Louisville, KY (US)

( * ) Notice: Subject to any disclaimer, the term of this patent is extended or adjusted under 35 U.S.C. 154(b) by 219 days.

(21) Appl. No.: 16/531,785

(22) Filed: Aug. 5, 2019

(65) Prior Publication Data

US 2020/0039673 A1 Feb. 6, 2020

Related U.S. Application Data

(60) Provisional application No. 62/715,032, filed on Aug. 6, 2018.

(51) Int. Cl.

| | |
|---|---|
| ***B65B 57/04*** | (2006.01) |
| ***B65B 11/02*** | (2006.01) |
| ***B65B 11/00*** | (2006.01) |
| ***B65B 41/16*** | (2006.01) |
| ***B65B 11/04*** | (2006.01) |

(52) U.S. Cl.

CPC ..... *B65B 57/04* (2013.01); *B65B 11/008* (2013.01); *B65B 11/025* (2013.01); *B65B 41/16* (2013.01); *B65B 11/045* (2013.01); *B65B 2011/002* (2013.01); *B65B 2210/18* (2013.01); *B65B 2210/20* (2013.01)

(58) Field of Classification Search

CPC ..... B65B 57/04; B65B 11/008; B65B 11/025; B65B 11/045; B65B 41/16; B65B 2011/002; B65B 2210/16; B65B 2210/18; B65B 2210/20; B65H 2220/01; B65H 2220/02; B65H 2513/104; B65H 23/1825; B65H 2801/81; B65H 20/005

USPC ..... 53/441

See application file for complete search history.

(56) References Cited

U.S. PATENT DOCUMENTS 2,227,398 A 12/1940 Mohl
2,904,196 A 9/1959 Teixeira
(Continued)

FOREIGN PATENT DOCUMENTS

DE 3140972 A1 6/1982
DE 3119038 A1 12/1982
(Continued)

OTHER PUBLICATIONS http://www.packworld.com/machinery/pallelizing/wulftec-international-inc-film-feeding-system-secure-product-containment Sep. 14, 2011.
(Continued)

*Primary Examiner* — Dariush Seif
(74) *Attorney, Agent, or Firm* — Middleton Reutlinger

(57) ABSTRACT

A method, apparatus and program product utilize curve fitting to control a dispense rate for a packaging material dispenser. Predicted demands at a plurality of rotational positions of a load relative to a packaging material dispenser may be used to generate one or more points to which a curve may be fit, such that dispense rates may be determined for rotational positions between those for which predicted demands have been determined using the curve.

47 Claims, 14 Drawing Sheets

(56) References Cited

U.S. PATENT DOCUMENTS 3,029,571 A 4/1962 Douthit
3,707,658 A 12/1972 Hilsenbeck
3,815,313 A 6/1974 Heisler
3,910,005 A 10/1975 Thimon et al.
4,152,879 A 5/1979 Shulman
4,216,640 A 8/1980 Kaufman
4,235,062 A 11/1980 Lancaster, III et al.
4,271,657 A 6/1981 Lancaster, III et al.
4,300,326 A 11/1981 Stackhouse
4,387,548 A 6/1983 Lancaster et al.
4,387,552 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,590,746 A 5/1986 Humphrey
4,628,667 A 12/1986 Humphrey et al.
4,676,048 A 6/1987 Lancaster et al.
4,693,049 A 9/1987 Humphrey
4,712,354 A 12/1987 Lancaster et al.
4,716,709 A 1/1988 Lamb et al.
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,855,924 A 8/1989 Strosser
4,862,678 A 9/1989 Humphrey
4,866,909 A 9/1989 Lancaster, III et al.
4,905,451 A 3/1990 Jaconelli et al.
4,953,336 A 9/1990 Lancaster, III et al.
4,991,381 A 2/1991 Simons
5,027,579 A 7/1991 Kelp
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,369,416 A 11/1994 Haverty et al.
5,414,979 A 5/1995 Moore et al.
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,634,321 A 6/1997 Martin-Cocher et al.
5,653,093 A 8/1997 Delledonne
5,671,593 A 9/1997 Glnestra et al.
5,765,344 A 6/1998 Mandeville et al.
5,768,862 A 6/1998 Mauro et al.
5,797,246 A 8/1998 Martin-Cocher
5,799,471 A 9/1998 Chen
5,836,140 A 11/1998 Lancaster, III
5,875,617 A 3/1999 Scherer
5,884,453 A 3/1999 Ramsey et al.
5,953,888 A 9/1999 Martin-Cocher et al.
6,082,081 A 7/2000 Mucha
6,185,900 B1 2/2001 Martin
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,338,480 B1 1/2002 Endo
6,360,512 B1 3/2002 Marois et al.
6,370,839 B1 4/2002 Nakagawa et al.
6,414,455 B1 7/2002 Watson
6,453,643 B1 9/2002 Buscherini et al.
6,516,591 B1 2/2003 Lancaster, III et al.
6,684,612 B2 2/2004 Trottet
6,698,161 B1 3/2004 Rossi
6,748,718 B2 6/2004 Lancaster, III et al.
6,826,893 B2 12/2004 Cere'
6,848,240 B2 2/2005 Frey
6,851,252 B2 2/2005 Maki-Rahkola et al.
6,918,229 B2 7/2005 Lancaster, III et al.
7,040,071 B2 5/2006 Heikaus
7,114,308 B2 10/2006 Cox
7,386,968 B2 6/2008 Sperry et al.
7,490,823 B2 2/2009 Oishi et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster, III et al.
7,779,607 B2 8/2010 Lancaster, III et al.
8,001,745 B2 8/2011 Carter et al.
8,037,660 B2 10/2011 Lancaster, III et al.
8,074,431 B1 12/2011 Pierson
8,276,346 B2 10/2012 Lancaster, III et al.
8,276,354 B2 10/2012 Lancaster, III et al.
8,448,412 B2 5/2013 Cere
8,739,502 B2 6/2014 Lancaster, III
8,915,460 B2 12/2014 Busch et al.
9,776,748 B2 10/2017 Lancaster et al.
10,015,057 B2 * 7/2018 Djukic ..... H04L 43/04
2001/0015057 A1 8/2001 Suolahtl
2003/0089081 A1 5/2003 Platon
2003/0110737 A1 6/2003 Lancaster et al.
2003/0145563 A1 8/2003 Cere'
2003/0200731 A1 10/2003 Maki-Rahkola et al.
2003/0200732 A1 10/2003 Maki-Rahkola et al.
2003/0205034 A1 11/2003 Sus et al.
2004/0031238 A1 2/2004 Cox
2004/0040477 A1 3/2004 Neumann
2005/0044812 A1 3/2005 Lancaster et al.
2005/0115202 A1 6/2005 Mertz et al.
2006/0028969 A1 2/2006 Kondo et al.
2006/0077246 A1 * 4/2006 Kawakami ..... B65H 7/00
347/104
2006/0213155 A1 9/2006 Forni et al.
2006/0248858 A1 11/2006 Lancaster
2006/0254214 A1 11/2006 Cox et al.
2006/0254225 A1 11/2006 Lancaster et al.
2006/0289691 A1 12/2006 Forni
2007/0204564 A1 9/2007 Lancaster et al.
2007/0204565 A1 9/2007 Lancaster et al.
2007/0209324 A1 9/2007 Lancaster et al.
2008/0216449 A1 * 9/2008 Zimmerli ..... B65B 13/18
53/399
2008/0229714 A1 9/2008 Zitella et al.
2008/0258382 A1 * 10/2008 deJong ..... G03G 15/6564
271/265.02
2008/0263999 A1 * 10/2008 Ohlsson ..... B32B 27/18
53/441
2008/0295614 A1 12/2008 Lancaster, III et al.
2009/0057477 A1 * 3/2009 Franklin ..... A61F 13/15772
242/562
2009/0178374 A1 7/2009 Lancaster, III et al.

(56) References Cited

U.S. PATENT DOCUMENTS

| | | | | |
|---|---|---|---|---|
| 2009/0293425 | A1 | 12/2009 | Carter et al. | |
| 2010/0107653 | A1 | 5/2010 | Paskevlch et al. | |
| 2010/0239403 | A1 | 9/2010 | Lancaster, III et al. | |
| 2010/0300049 | A1 | 12/2010 | Schmidt et al. | |
| 2010/0303526 | A1 | 12/2010 | Hayase | |
| 2010/0320305 | A1 | 12/2010 | Lia | |
| 2011/0131927 | A1* | 6/2011 | Lancaster, III | B65B 57/00 53/461 |
| 2011/0146203 | A1 | 6/2011 | Lancaster, III et al. | |
| 2011/0153277 | A1 | 6/2011 | Morath | |
| 2011/0168751 | A1 | 7/2011 | Tsurumi | |
| 2011/0179752 | A1 | 7/2011 | Lancaster, III et al. | |
| 2012/0031053 | A1 | 2/2012 | Lancaster, III et al. | |
| 2012/0102886 | A1 | 5/2012 | Lancaster, III | |
| 2012/0102887 | A1 | 5/2012 | Lancaster, III et al. | |
| 2012/0124944 | A1 | 5/2012 | Lancaster, III et al. | |
| 2012/0181368 | A1 | 7/2012 | Ekola | |
| 2013/0076753 | A1 | 3/2013 | Lancaster, III et al. | |
| 2014/0116006 | A1* | 5/2014 | Lancaster, III | B65B 11/045 53/461 |
| 2014/0116007 | A1 | 5/2014 | Lancaster, III et al. | |
| 2014/0116008 | A1* | 5/2014 | Lancaster, III | B65B 11/025 53/461 |
| 2014/0223864 | A1* | 8/2014 | Lancaster, III | B65B 11/58 53/436 |
| 2014/0319194 | A1* | 10/2014 | Swanson | B65H 23/038 226/179 |
| 2015/0197360 | A1* | 7/2015 | Lancaster, III | B65B 11/025 53/461 |
| 2015/0353220 | A1 | 12/2015 | Lancaster, III | |
| 2016/0096645 | A1* | 4/2016 | Lancaster, III | B65B 59/001 53/461 |
| 2016/0096646 | A1 | 4/2016 | Lancaster, III | |
| 2017/0039461 | A1* | 2/2017 | Winteraeken | H04N 1/00734 |
| 2017/0088301 | A1 | 3/2017 | Riemenschneider | |

FOREIGN PATENT DOCUMENTS

| | | | |
|---|---|---|---|
| DE | 3634924 | A1 | 4/1988 |
| DE | 3901704 | A1 | 8/1990 |
| DE | 4234604 | A1 | 4/1994 |
| DE | 19509649 | | 9/1996 |
| EP | 0096635 | A1 | 12/1983 |
| EP | 0144266 | A2 | 6/1985 |
| EP | 0246659 | A1 | 11/1987 |
| EP | 0466980 | A1 | 1/1992 |
| EP | 0653352 | A1 | 5/1995 |
| EP | 0671324 | A1 | 9/1995 |
| EP | 0811554 | A1 | 12/1997 |
| EP | 0842850 | A2 | 5/1998 |
| EP | 1125841 | A1 | 8/2001 |
| EP | 1213223 | A1 | 6/2002 |
| EP | 1489004 | A1 | 12/2004 |
| EP | 1705119 | A1 | 9/2006 |
| EP | 1717149 | A1 | 11/2006 |
| EP | 1736426 | A2 | 12/2006 |
| EP | 1736426 | A3 | 10/2007 |
| GB | 1546523 | A | 5/1979 |
| GB | 2059906 | A | 4/1981 |
| GB | 2107668 | A | 5/1983 |
| GB | 2437359 | A | 10/2007 |
| JP | 57166252 | | 10/1982 |
| JP | 63191707 | | 8/1988 |
| JP | 0385209 | | 4/1991 |
| JP | 06239311 | | 8/1994 |
| JP | 085448 | | 1/1996 |
| JP | 09254913 | A | 9/1997 |
| JP | 11165705 | A | 6/1999 |
| JP | 2001048111 | | 2/2001 |
| JP | 2001072012 | A | 3/2001 |
| JP | 2002211503 | | 7/2002 |
| JP | 2004161344 | A | 6/2004 |
| JP | 3634993 | | 1/2005 |
| JP | 4350940 | | 10/2009 |
| WO | WO 9107341 | A1 | 5/1991 |
| WO | WO 9420367 | A1 | 9/1994 |
| WO | WO 9700202 | A1 | 1/1997 |
| WO | WO 9822346 | A1 | 5/1998 |
| WO | WO 2004069659 | A1 | 8/2004 |
| WO | WO 2006032065 | A1 | 3/2006 |
| WO | WO 2006110596 | A1 | 10/2006 |
| WO | WO 2007071593 | A1 | 6/2007 |
| WO | WO 2007100596 | A2 | 9/2007 |
| WO | WO 2007100597 | A2 | 9/2007 |
| WO | WO 2008007189 | A2 | 1/2008 |
| WO | WO 2008115868 | A1 | 9/2008 |
| WO | WO 2008129432 | A1 | 10/2008 |
| WO | WO2011057166 | A2 | 5/2011 |
| WO | WO 2012058549 | A2 | 5/2012 |
| WO | WO2017123832 | A1 | 7/2017 |

OTHER PUBLICATIONS http://literature.rockwellautomation.com/idc/groups/literature/documents/ap/oem-ap069_-3n-p.pdf. Aug. 1, 2011.

http://www.wulftec.com/contents/brochures/015f519c-8a1a-4a0b-81d1-727cbdcbf946.pdf. Oct. 10, 2012.

http://www.mhpn.com/product/force_anticipation_stretch_technology_for_stretch_wrappers/packaging. Nov. 23, 2012.

Machine translation of DE 4234604 retrieved from EPO website http://epo.worldlingo.com/wl/epo/epo.html, on Sep. 29, 2010, 3 pages.

Machine translation of DE 3634924 retrieved from EPO website http://epo.worldlingo.com/wl/epo/epo.html, on Sep. 29, 2010, 5 pages.

JPO machine translation JP 09254913 A, retrieved from http://www4.ipdl.inpit.go.jp/Tokujitu/tjsogodbenk.ipdl, Jun. 25, 2012, 11 pages.

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.

Bossler, John D., "Manual of Geospatial Science and Technology", CRC Press 2001, pp. 8-15.

European Patent Office; Search Report and Written Opinion in International Patent Application No. PCT/US2019/045098 dated Dec. 4, 2019; 25 pages (425WO).

Yang, et al. "Study on Solidas Translational and Rotational Motions in Rotating Cans" University of Birmingham, 2014 Elsevier Ltd. 10 Pages.

European Patent Office; Supplementary European Search Report issued in Patent Application No. 19846992.6 dated Sep. 10, 2021; 5 pages.

* cited by examiner

STRETCH WRAPPING MACHINE WITH CURVE FIT CONTROL OF DISPENSE RATE

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force or tension applied to the load while wrapping the load. An insufficient containment force can lead to undesirable shifting of a wrapped load during later transportation or handling, and may in some instances result in damaged products. On the other hand, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns can be a challenge.

In particular, wrappers have historically suffered from packaging material breaks and limitations on the amount of wrap force applied to the load (as determined in part by the amount of pre-stretch used) due to erratic speed changes required to wrap loads. Were all loads perfectly cylindrical in shape and centered precisely at the center of rotation for the relative rotation, the rate at which packaging material would need to be dispensed would be constant throughout the rotation. Typical loads, however, are generally box-shaped, and have a square or rectangular cross-section in the plane of rotation, such that even in the case of square loads, the rate at which packaging material is dispensed varies throughout the rotation. In some instances, loosely wrapped loads result due to the supply of excess packaging material during portions of the wrapping cycle where the demand rate for packaging material by the load is exceeded by the rate at which the packaging material is supplied by the packaging material dispenser. In other instances, when the demand rate for packaging material by the load is greater than the supply rate of the packaging material by the packaging material dispenser, breakage of the packaging material may occur.

When wrapping a typical rectangular load, the demand for packaging material typically decreases as the packaging material approaches contact with a corner of the load and increases after contact with the corner of the load. When wrapping a tall, narrow load or a short load, the variation in the demand rate is typically even greater than in a typical rectangular load. In vertical rotating rings, high speed rotating arms, and turntable apparatuses, the variation is caused by a difference between the length and the width of the load, while in a horizontal rotating ring apparatus, the variation is caused by a difference between the height of the load (distance above the conveyor) and the width of the load. Variations in demand may make it difficult to properly wrap the load, and the problem with variations may be exacerbated when wrapping a load having one or more dimensions that may differ from one or more corresponding dimensions of a preceding load. The problem may also be exacerbated when wrapping a load having one or more dimensions that vary at one or more locations of the load itself. Furthermore, whenever a load is not centered precisely at the center of rotation of the relative rotation, the variation in the demand rate is also typically greater, as the corners and sides of even a perfectly symmetric load will be different distances away from the packaging material dispenser as they rotate past the dispenser.

The amount of force, or pull, that the packaging material exhibits on the load determines in part how tightly and securely the load is wrapped. Conventionally, this wrap force is controlled by controlling the feed or supply rate of the packaging material dispensed by the packaging material dispenser. For example, the wrap force of many conventional stretch wrapping machines is controlled by attempting to alter the supply of packaging material such that a relatively constant packaging material wrap force is maintained. With powered pre-stretching devices, changes in the force or tension of the dispensed packaging material are monitored, e.g., by using feedback mechanisms typically linked to spring loaded dancer bars, electronic load cells, or torque control devices. The changing force or tension of the packaging material caused by rotating a rectangular shaped load is transmitted back through the packaging material to some type of sensing device, which attempts to vary the speed of the motor driven dispenser to minimize the change. The passage of the corner causes the force or tension of the packaging material to increase, and the increase is typically transmitted back to an electronic load cell, spring-loaded dancer interconnected with a sensor, or to a torque control device. As the corner approaches, the force or tension of the packaging material decreases, and the reduction is transmitted back to some device that in turn reduces the packaging material supply to attempt to maintain a relatively constant wrap force or tension.

With the ever faster wrapping rates demanded by the industry, however, rotation speeds have increased significantly to a point where the concept of sensing changes in force and altering supply speed in response often loses effectiveness. The delay of response has been observed to begin to move out of phase with rotation at approximately 20 RPM. Given that a packaging dispenser is required to shift between accelerating and decelerating eight times per revolution in order to accommodate the four corners of the load, at 20 RPM the shift between acceleration and deceleration occurs at a rate of more than once every half of a second. Given also that the rotating mass of a packaging material roll and rollers in a packaging material dispenser may be 100 pounds or more, maintaining an ideal dispense rate throughout the relative rotation can be a challenge.

Also significant is the need in many applications to minimize acceleration and deceleration times for faster cycles. Initial acceleration must pull against clamped packaging material, which typically cannot stand a high force, and especially the high force of rapid acceleration, which typically cannot be maintained by the feedback mechanisms described above. As a result of these challenges, the use of high speed wrapping has often been limited to relatively lower wrap forces and pre-stretch levels where the loss of control at high speeds does not produce undesirable packaging material breaks.

Therefore, a significant need continues to exist in the art for an improved manner of reliably and efficiently controlling a wrapping machine.

SUMMARY OF THE INVENTION

The invention addresses these and other problems associated with the art by providing a method, apparatus and program product that utilize curve fitting to control a dispense rate for a packaging material dispenser. Predicted demands at a plurality of rotational positions of a load relative to a packaging material dispenser may be used to generate one or more points to which a curve may be fit, such that dispense rates may be determined for rotational positions between those for which predicted demands have been determined using the curve.

Therefore, consistent with one aspect of the invention, an apparatus for wrapping a load with packaging material may include a packaging material dispenser for dispensing packaging material to the load, a rotational drive configured to generate relative rotation between the packaging material dispenser and the load about a center of rotation, and a controller coupled to the packaging material dispenser and the rotational drive and configured to control the packaging material dispenser during the relative rotation to dispense at a first dispense rate at a first rotational position about the center of rotation. The first dispense rate at which the controller controls the packaging material dispenser at the first rotational position is determined using a curve fit between second and third rotational positions that are respectively before and after the first rotational position about the center of rotation and for which predicted demands are determined.

In some embodiments, the curve is a demand curve defining a demand at each of a plurality of rotational positions between the second and third rotational positions. Also, in some embodiments, the first dispense rate is determined by scaling a demand from the demand curve based upon a wrap force parameter.

Further, in some embodiments, the curve is a dispense rate curve defining a dispense rate at each of a plurality of rotational positions between the second and third rotational positions, where the dispense rate at the second rotational position is determined by scaling the predicted demand at the second rotational position by a wrap force parameter, and where the dispense rate at the third rotational position is determined by scaling the predicted demand at the third rotational position by the wrap force parameter.

In some embodiments, the curve includes a portion of a sinusoidal curve fit between the second and third rotational positions. In addition, in some embodiments, the first dispense rate at the first rotational position is further determined by applying a rotational data shift to offset system lag. In some embodiments, the rotational data shift is variable based upon a rotational drive speed. In addition, in some embodiments, the rotational data shift is applied by rotationally shifting a sensed rotational position of the load. Moreover, in some embodiments, the rotational data shift is applied by rotationally shifting the curve.

In some embodiments, the predicted demand at the second rotational position is determined based upon a geometric relationship between the packaging material dispenser and a location of a corner of the load within a plane perpendicular to the center of rotation. Moreover, in some embodiments, the predicted demand at the second rotational position is determined based upon a rotation angle about the center of rotation and associated with the corner of the load. In some embodiments, the rotation angle is a corner location angle. In addition, in some embodiments, the rotation angle is a corner contact angle representing an angle at which packaging material first comes into contact with the corner during the relative rotation between the load and the packaging material dispenser.

In some embodiments, the predicted demand at the second rotational position is determined based upon a sensed tension in a web of packaging material extending between the packaging material dispenser and a corner of the load. Moreover, in some embodiments, the second rotational position is a corner contact angle representing an angle at which packaging material first comes into contact with a corner of the load during the relative rotation between the load and the packaging material dispenser.

Also, in some embodiments, the second rotational position is a rotational position associated with a local minimum in demand. In some embodiments, the second rotational position is a rotational position associated with a local maximum in demand. In addition, in some embodiments, the second rotational position is a rotational position where a corner radial for a corner of the load forms about a 90 degree angle with a web of packaging material extending between the packaging material dispenser and the corner of the load.

Also, in some embodiments, the second and third rotational positions are rotational positions respectively before and after the first rotational position about the center of rotation, where a fourth rotational position is a corner contact angle, and where the curve is fit between the second, third and fourth rotational positions. Moreover, in some embodiments, the second rotational position is a rotational position associated with a local minimum in demand, where the third rotational position is a rotational position associated with a local maximum in demand, where a fourth rotational position is associated with a rising inflection point having a demand value calculated from an average of the local minimum in demand and the local maximum in demand, and where the curve includes a quarter sine curve segment fit between the second, third and fourth rotational positions. Further, in some embodiments, the second rotational position is a rotational position associated with a local maximum in demand, where the third rotational position is a rotational position associated with a local minimum in demand, where a fourth rotational position is associated with a falling inflection point having a demand value calculated from an average of the local maximum in demand and the local minimum in demand, and where the curve includes a quarter sine curve segment fit between the second, third and fourth rotational positions.

Also, in some embodiments, the second rotational position is a corner contact angle for a current corner, where the third rotational position is a rotational position associated with a local maximum in demand between the corner contact angle for the current corner and a corner contact angle for a next corner, where a fourth rotational position is associated with a rising inflection point having a demand value calculated from an average of the determined predicted demand for the corner contact angle for the current corner and the local maximum in demand, and where the curve includes a quarter sine curve segment fit between the second, third and fourth rotational positions. Further, in some embodiments, the second rotational position is a rotational position associated with a local maximum in demand, where the third rotational position is a corner contact angle for a next corner, where a fourth rotational position is associated with a falling inflection point having a demand value calculated from an average of the local maximum in demand and the determined predicted demand for the corner contact angle for the next corner, and where the curve includes a quarter sine curve segment fit between the second, third and fourth rotational positions.

In some embodiments, the curve decreases a rate of change in dispense rate relative to a dispense rate calculated based on predicted demand when the packaging material dispenser is transitioning between acceleration and deceleration. Also, in some embodiments, the curve decreases a rate of change in dispense rate relative to a dispense rate calculated based on predicted demand when the packaging material dispenser is transitioning between acceleration and deceleration proximate a corner of the load.

In some embodiments, the curve includes a plurality of segments spanning a full revolution about the center of rotation, each segment fit between two or more rotational positions for which predicted demands are determined. Further, in some embodiments, each segment includes a portion of a sinusoidal curve fit between two or more rotational positions for which predicted demands are determined. In some embodiments, the plurality of segments includes eight segments, each of the eight segments spanning between a rotational position associated with a local minimum in demand and a rotational position associated with a local maximum in demand.

Further, in some embodiments, the curve includes a quarter sine curve segment fit between the second and third rotational positions. Also, in some embodiments, the curve is fit using values determined for each of the second and third rotational positions using the respective predicted demands determined for the second and third rotational positions. In addition, in some embodiments, the values for each of the second and third rotational positions are equal to the respective predicted demands determined for the second and third rotational positions.

In some embodiments, the value for the second rotational position is scaled relative to the predicted demand determined for the second rotational position. In addition, in some embodiments, the value for the second rotational position is scaled using a wrap force parameter. Also, in some embodiments, the value for the second rotational position is scaled such that the dispense rate of the packaging material dispenser varies within a reduced range of dispense rates.

In addition, in some embodiments, the controller is configured to determine the first dispense rate. In some embodiments, the controller is further configured to determine a first demand for the first rotational position using the curve and determine the first dispense rate by scaling the determined first demand. Further, in some embodiments, the controller is configured to receive a first demand for the first rotational position from an external device in communication with the controller, and where the controller is configured to determine the first dispense rate by scaling the first demand. In addition, in some embodiments, the controller is configured to receive the first dispense rate from an external device in communication with the controller and configured to determine the first dispense rate.

Consistent with another aspect of the invention, a method of wrapping a load with packaging material using a wrapping apparatus of the type including a packaging material dispenser for dispensing packaging material to the load may include generating relative rotation between the packaging material dispenser and the load about a center of rotation, and controlling the packaging material dispenser during the relative rotation to dispense at a first dispense rate at a first rotational position about the center of rotation, where the first dispense rate is determined using a curve fit between second and third rotational positions that are respectively before and after the first rotational position about the center of rotation and for which predicted demands are determined.

Some embodiments may further include determining the first dispense rate using a controller of the wrapping apparatus. Some embodiments may also include determining a first demand for the first rotational position in the controller using the curve, where the controller determines the first dispense rate by scaling the determined first demand. In addition, some embodiments may further include receiving a first demand for the first rotational position from an external device in communication with the controller, where the controller determines the first dispense rate by scaling the first demand. Some embodiments may further include receiving the first dispense rate from an external device in communication with the controller and configured to determine the first dispense rate.

In addition, in some embodiments, the curve is a demand curve defining a demand at each of a plurality of rotational positions between the second and third rotational positions. In addition, some embodiments may also include determining the first dispense rate by scaling a demand from the demand curve based upon a wrap force parameter. Also, in some embodiments, the curve is a dispense rate curve defining a dispense rate at each of a plurality of rotational positions between the second and third rotational positions, the method further including determining the dispense rate at the second rotational position by scaling the predicted demand at the second rotational position by a wrap force parameter, and determining the dispense rate at the third rotational position by scaling the predicted demand at the third rotational position by the wrap force parameter. Moreover, in some embodiments, the curve includes a portion of a sinusoidal curve fit between the second and third rotational positions.

In addition, some embodiments may further include determining the first dispense rate at the first rotational position further by applying a rotational data shift to offset system lag. In some embodiments, the rotational data shift is variable based upon a rotational drive speed.

Some embodiments may further include determining the predicted demand at the second rotational position based upon a geometric relationship between the packaging material dispenser and a location of a corner of the load within a plane perpendicular to the center of rotation. Some embodiments may also include determining the predicted demand at the second rotational position based upon a rotation angle about the center of rotation and associated with the corner of the load. Further, in some embodiments, the rotation angle is a corner location angle or a corner contact angle representing an angle at which packaging material first comes into contact with the corner during the relative rotation between the load and the packaging material dispenser.

In addition, some embodiments may also include determining the predicted demand at the second rotational position based upon a sensed tension in a web of packaging material extending between the packaging material dispenser and a corner of the load.

Also, in some embodiments, the second rotational position is a corner contact angle representing an angle at which packaging material first comes into contact with a corner of the load during the relative rotation between the load and the packaging material dispenser. In addition, in some embodiments, the second rotational position is a rotational position associated with a local minimum in demand. Moreover, in some embodiments, the second rotational position is a rotational position associated with a local maximum in demand. In some embodiments, the second rotational position is a rotational position where a corner radial for a corner of the load forms about a 90 degree angle with a web of packaging material extending between the packaging material dispenser and the corner of the load.

Further, in some embodiments, the second and third rotational positions are rotational positions respectively before and after the first rotational position about the center of rotation, where a fourth rotational position is a corner contact angle, and where the curve is fit between the second, third and fourth rotational positions. In some embodiments, the second rotational position is a rotational position associated with a local minimum in demand, where the third rotational position is a rotational position associated with a local maximum in demand, where a fourth rotational position is associated with a rising inflection point having a demand value calculated from an average of the local minimum in demand and the local maximum in demand, and where the curve includes a quarter sine curve segment fit between the second, third and fourth rotational positions. Moreover, in some embodiments, the second rotational position is a rotational position associated with a local maximum in demand, where the third rotational position is a rotational position associated with a local minimum in demand, where a fourth rotational position is associated with a falling inflection point having a demand value calculated from an average of the local maximum in demand and the local minimum in demand, and where the curve includes a quarter sine curve segment fit between the second, third and fourth rotational positions.

Further, in some embodiments, the second rotational position is a corner contact angle for a current corner, where the third rotational position is a rotational position associated with a local maximum in demand between the corner contact angle for the current corner and a corner contact angle for a next corner, where a fourth rotational position is associated with a rising inflection point having a demand value calculated from an average of the determined predicted demand for the corner contact angle for the current corner and the local maximum in demand, and where the curve includes a quarter sine curve segment fit between the second, third and fourth rotational positions. In some embodiments, the second rotational position is a rotational position associated with a local maximum in demand, where the third rotational position is a corner contact angle for a next corner, where a fourth rotational position is associated with a falling inflection point having a demand value calculated from an average of the local maximum in demand and the determined predicted demand for the corner contact angle for the next corner, and where the curve includes a quarter sine curve segment fit between the second, third and fourth rotational positions.

Also, in some embodiments, the curve decreases a rate of change in dispense rate relative to a dispense rate calculated based on predicted demand when the packaging material dispenser is transitioning between acceleration and deceleration. Moreover, in some embodiments, the curve decreases a rate of change in dispense rate relative to a dispense rate calculated based on predicted demand when the packaging material dispenser is transitioning between acceleration and deceleration proximate a corner of the load.

In addition, in some embodiments, the curve includes a plurality of segments spanning a full revolution about the center of rotation, each segment fit between two or more rotational positions for which predicted demands are determined. Also, in some embodiments, each segment includes a sine curve fit between two or more rotational positions for which predicted demands are determined. In some embodiments, the plurality of segments includes eight segments, each of the eight segments spanning between a rotational position associated with a local minimum in demand and a rotational position associated with a local maximum in demand.

In addition, in some embodiments, the curve includes a quarter sine curve segment fit between the second and third rotational positions. Also, in some embodiments, the curve is fit using values determined for each of the second and third rotational positions using the respective predicted demands determined for the second and third rotational positions. In some embodiments, the values for each of the second and third rotational positions are equal to the respective predicted demands determined for the second and third rotational positions. Moreover, in some embodiments, the value for the second rotational position is scaled relative to the predicted demand determined for the second rotational position. In some embodiments, the value for the second rotational position is scaled using a wrap force parameter. Also, in some embodiments, the value for the second rotational position is scaled such that the dispense rate of the packaging material dispenser varies within a reduced range of dispense rates.

Consistent with another aspect of the invention, a program product may include a computer readable medium, and program code configured upon execution by a controller in an apparatus that wraps a load with packaging material using a packaging material dispenser adapted for relative rotation with the load about a center of rotation, where the program code is configured to perform any of the herein-described methods.

Consistent with another aspect of the invention, an apparatus for wrapping a load with packaging material may include a packaging material dispenser for dispensing packaging material to the load, a rotational drive configured to generate relative rotation between the packaging material dispenser and the load about a center of rotation, and a controller coupled to the packaging material dispenser and the rotational drive and configured to control a dispense rate of the packaging material dispenser during the relative rotation. The controller is further configured to determine a first predicted demand for packaging material at the load for a first rotational position about the center of rotation, determine a second predicted demand for packaging material at the load for a second rotational position about the center of rotation, and determine a plurality of dispense rates for a plurality of rotational positions between the first and second rotational positions based upon a curve that is fit between the first and second rotational positions.

Moreover, in some embodiments, the curve is a demand curve, and where the curve departs from a predicted demand for packaging material at the load for at least a subset of the plurality of rotational positions. Further, in some embodiments, the curve is a dispense rate curve, and where the curve departs from a dispense rate associated with a predicted demand for packaging material at the load for at least a subset of the plurality of rotational positions.

Consistent with another aspect of the invention, an apparatus for wrapping a load with packaging material may include a packaging material dispenser for dispensing packaging material to the load, a rotational drive configured to generate relative rotation between the packaging material dispenser and the load about a center of rotation, a controller coupled to the packaging material dispenser and the rotational drive and configured to control a dispense rate of the packaging material dispenser during the relative rotation using a wrap model, and one or more processors configured to execute instructions to generate the wrap model by determining a first predicted demand for packaging material at the load for a first rotational position about the center of rotation, determining a second predicted demand for packaging material at the load for a second rotational position about the center of rotation, and determining a plurality of dispense rates for a plurality of rotational positions between the first and second rotational positions based upon a curve that is fit between the first and second rotational positions.

Consistent with another aspect of the invention, an apparatus for wrapping a load with packaging material may include a packaging material dispenser for dispensing packaging material to the load, a rotational drive configured to generate relative rotation between the packaging material dispenser and the load about a center of rotation, and a controller coupled to the packaging material dispenser and the rotational drive and configured to control a dispense rate of the packaging material dispenser during the relative rotation using a wrap model, where the wrap model defines a dispense rate for each of a plurality of rotational positions about the center of rotation, and where at a first rotational position among the plurality of rotational positions, the wrap model defines a first dispense rate for the packaging material dispenser based upon a first predicted demand for packaging material at the load for the first rotational position, at a second rotational position among the plurality of rotational positions, the wrap model defines a second dispense rate for the packaging material dispenser based upon a second predicted demand for packaging material at the load for the second rotational position, and at each of multiple rotational positions among the plurality of rotational positions between the first and second rotational positions, the wrap model defines a respective dispense rate based upon a curve that is fit between the first and second rotational positions.

Consistent with another aspect of the invention, an apparatus for wrapping a load with packaging material may include a packaging material dispenser for dispensing packaging material to the load, a rotational drive configured to generate relative rotation between the packaging material dispenser and the load about a center of rotation, and a controller coupled to the packaging material dispenser and the rotational drive and configured to control the packaging material dispenser during the relative rotation to dispense at a first dispense rate at a first rotational position about the center of rotation, where the first dispense rate at which the controller controls the packaging material dispenser at the first rotational position is determined using a portion of a sinusoidal curve fit between second and third rotational positions that are respectively before and after the first rotational position about the center of rotation.

In addition, in some embodiments, each of the second and third rotational positions is a rotational position associated with a local minimum or maximum in demand. Further, in some embodiments, the portion of the sinusoidal curve is a quarter sine wave segment. In some embodiments, a fourth rotational position is associated with an inflection point having a first value calculated from an average of a second value for the second rotational position and a third value for the third rotational position, and where the portion of the sinusoidal curve is further fit to the fourth rotational position. In addition, in some embodiments, the second value equals a predicted demand at the second rotational position and the third value equals a predicted demand at the third rotational position. Moreover, in some embodiments, the second value is scaled relative to a predicted demand determined for the second rotational position. In addition, in some embodiments, the second value is scaled using a wrap force parameter. Moreover, in some embodiments, the second value is scaled such that the dispense rate of the packaging material dispenser varies within a reduced range of dispense rates.

Consistent with another aspect of the invention, a method of wrapping a load with packaging material using a wrapping apparatus of the type including a packaging material dispenser for dispensing packaging material to the load may include generating relative rotation between the packaging material dispenser and the load about a center of rotation, and controlling the packaging material dispenser during the relative rotation to dispense at a first dispense rate at a first rotational position about the center of rotation, where the first dispense rate is determined using a portion of a sinusoidal curve fit between second and third rotational positions that are respectively before and after the first rotational position about the center of rotation.

Consistent with another aspect of the invention, a method of wrapping a load with packaging material using a wrapping apparatus of the type including a packaging material dispenser for dispensing packaging material to the load may include generating relative rotation between the packaging material dispenser and the load about a center of rotation, sensing with an angle sensor an angular relationship between the load and the packaging material dispenser about the center of rotation, calculating locations of both a current corner and a next corner of the load within a plane perpendicular to the center of rotation, and controlling the packaging material dispenser during the relative rotation to dispense at a first dispense rate at a first rotational position about the center of rotation, where the first dispense rate is determined using a curve fit between second and third rotational positions that are respectively before and after the first rotational position about the center of rotation and for which predicted demands are determined, where the second rotational position corresponds to a corner contact angle for the current corner and the third rotational position corresponds to a corner contact angle for the next corner.

Further, in some embodiments, the curve is a first curve, and the method further includes determining when the packaging material will engage the next corner of the load using the sensed angular relationship, and after determining that the packaging material has engaged the next corner, controlling the packaging material dispenser to dispense at a second dispense rate at a fourth rotational position about the center of rotation that is after the third rotational position, where the second dispense rate is determined using a second curve fit between the third rotational position and a fifth rotational position after the fourth rotational position and corresponding to a corner contact angle for a corner that follows the next corner.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention may utilize curve fitting to control a dispense rate for a packaging material dispenser. Predicted demands at a plurality of rotational positions of a load relative to a packaging material dispenser may be used to generate one or more points to which a curve may be fit, such that dispense rates may be determined for rotational positions between those for which predicted demands have been determined using the curve. Prior to a further discussion of these various techniques, however, a brief discussion of various types of wrapping apparatus within which the various techniques disclosed herein may be implemented is provided.

Wrapping Apparatus Configurations

Figure 1:
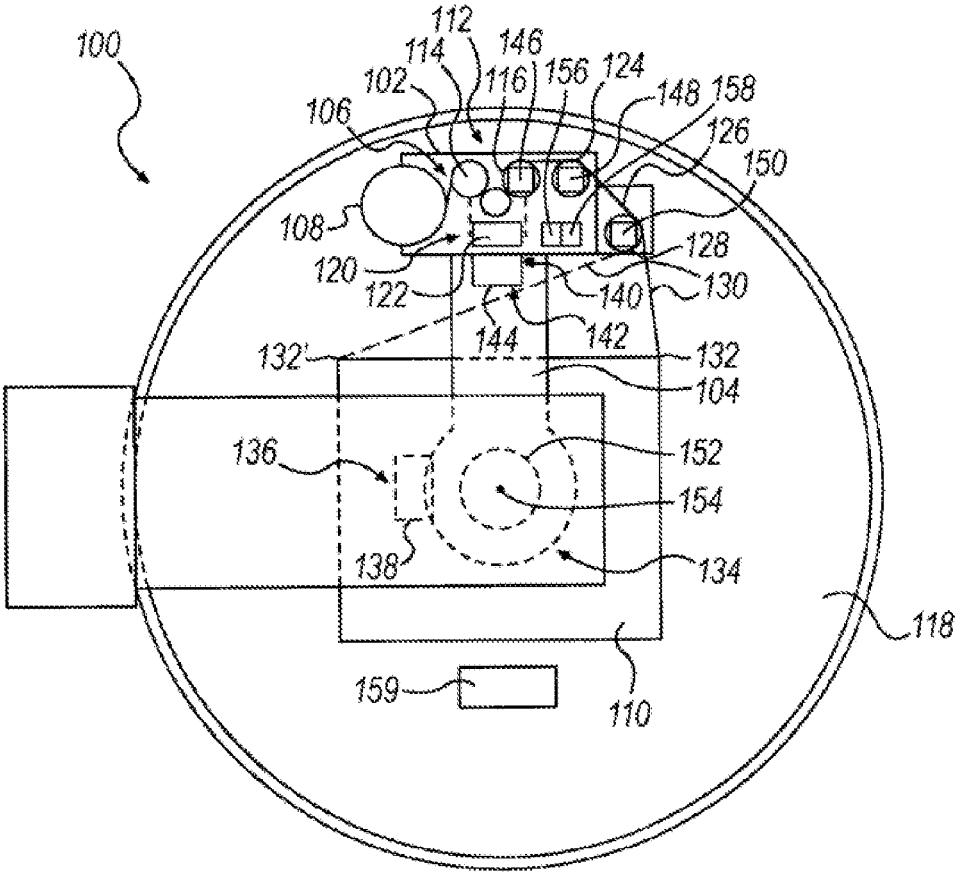
FIG. 1 shows a top view of a rotating arm-type wrapping apparatus consistent with the invention.

Various wrapping apparatus configurations may be used in various embodiments of the invention. For example, FIG. 1 illustrates a rotating arm-type wrapping apparatus 100, which includes a roll carriage or elevator 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114. Moreover, in some embodiments the roll of packaging material 108 may be undriven and may rotate freely, while in other embodiments the roll may be driven, e.g., by biasing a surface of the roll against upstream dispensing roller 114 or another driven roller, or by driving the roll directly.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions. In other embodiments, however, packaging material dispenser 106 may be driven proportionally to the relative rotation, or alternatively, tension in the packaging material extending between the packaging material dispenser and the load may be used to drive the packaging material dispenser.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, generally in a direction parallel to an axis of rotation between the packaging material dispenser 106 and load 110 and load support surface 118. For example, for wrapping apparatus 100, lift drive system 142 may drive roll carriage 102 and packaging material dispenser 106 upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154. Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships. Other sensors may also be used to determine the height and/or other dimensions of a load, among other information.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photoeye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative). In one embodiment, film angle sensor 158 may be implemented using a distance sensor, e.g., a photoeye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material.

Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
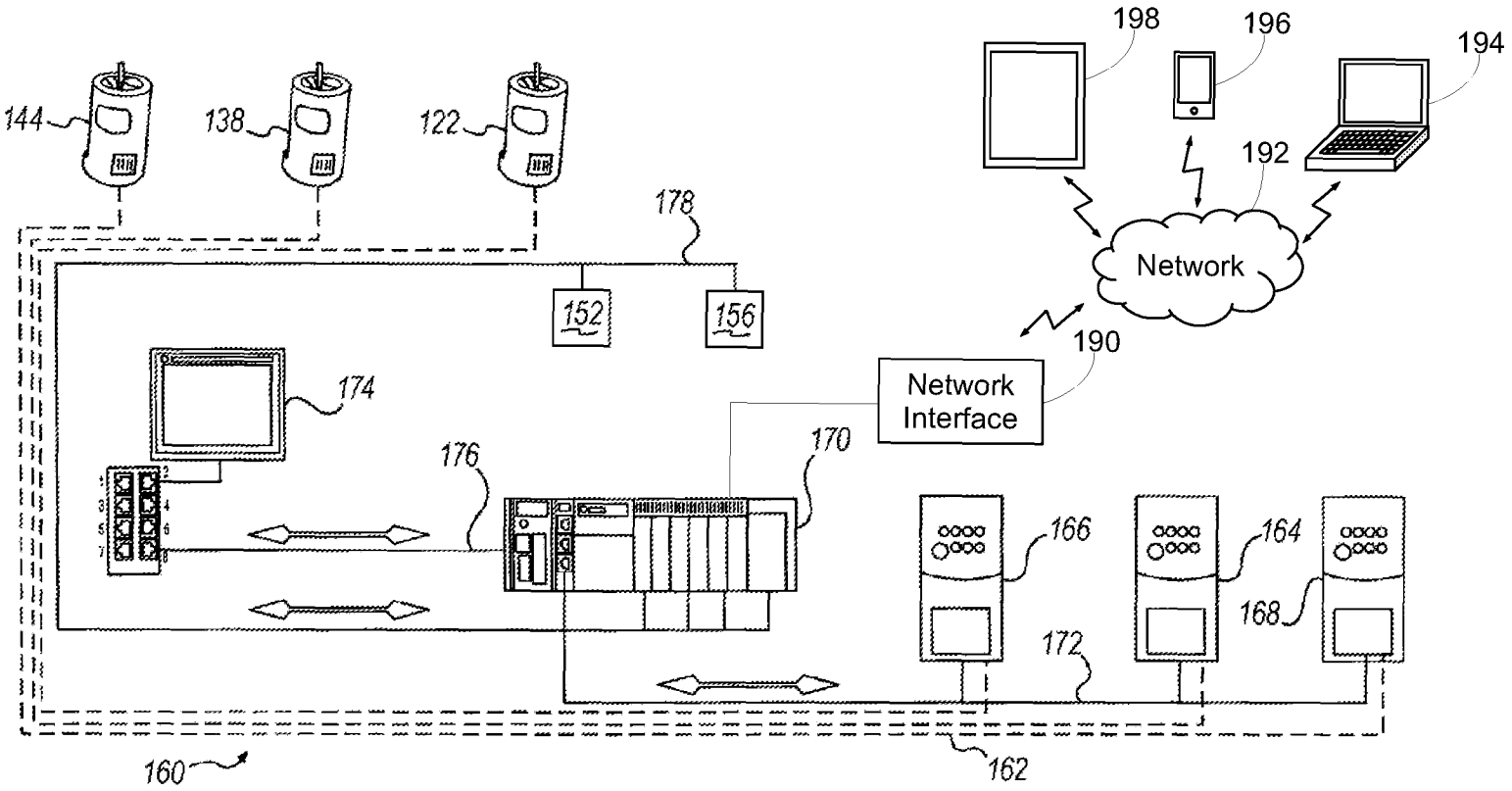
FIG. 2 is a schematic view of an example control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 152 and 156, among others, through a data link 178 to allow controller 170 to receive feedback and/or performance-related data during wrapping, such as roller and/or drive rotation speeds, load dimensional data, etc. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100. At least portions of a controller in some embodiments may also be implemented in a central server, a cloud service, a mobile device, or other computing device that is physically remote and/or separate from a wrapping apparatus.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in the controller, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user or other input, converting the input into control variables for controlling a wrap operation, initiating and implementing a wrap operation based upon the control variables, providing feedback to a user, etc., may be implemented by various local and/or remote components and combinations thereof in different embodiments. In some embodiments, for example, an external device such as a mobile device, a networked computer, a server, a cloud service, etc. may generate a wrap model that defines the control variables for controlling a wrap operation for a particular load, and that wrap model may then be communicated to a wrapping apparatus and used by a controller therefor to control a dispense rate during a wrap operation. As such, the invention is not limited to the particular allocation of functionality described herein.

Figure 3:
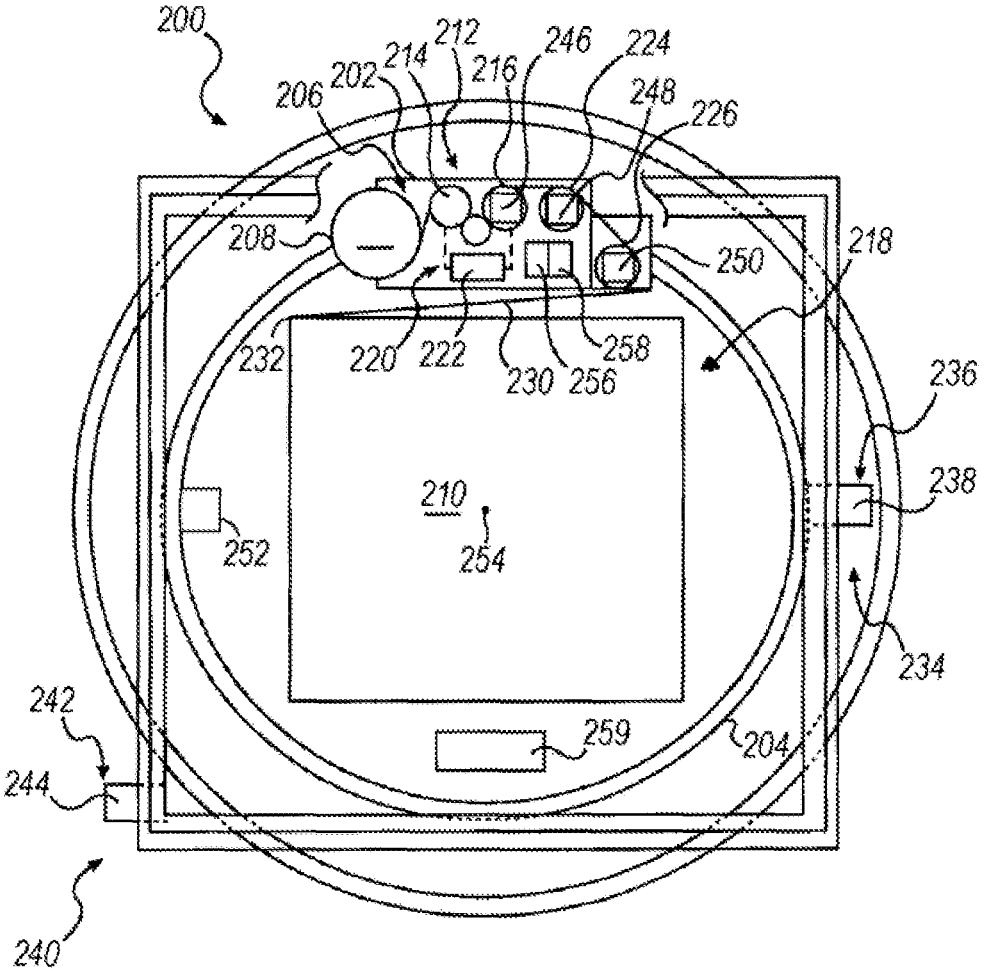
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage or elevator 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254, and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
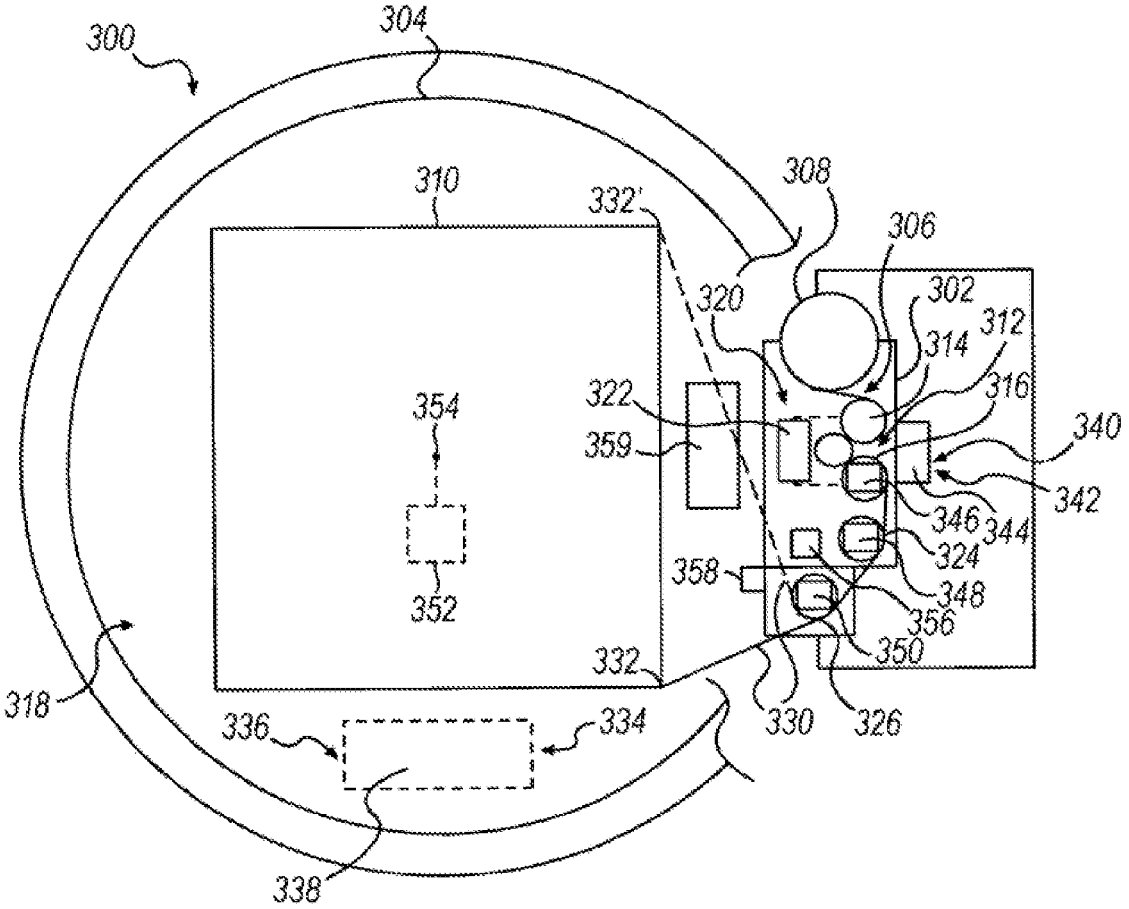
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage or elevator 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a roll carriage or elevator 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move roll carriage or elevator 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Dispense Rate Control Using Curve Fitting

In the embodiments discussed hereinafter, curve fitting is used to control the dispense rate of a packaging material dispenser during at least a portion of a wrap cycle performed to wrap a load with packaging material. In particular, in some embodiments, the dispense rate at which to dispense packaging material at a particular rotational position of a packaging material dispenser relative to a load about a center of rotation is determined at least in part using a curve fit between two or more points associated with other rotational positions for which predicted demands have been determined. In some embodiments, for example, for a particular rotational position between two rotational positions that are before and after the particular rotational position, and for which predicted demands have been determined, a dispense rate may be calculated using a curve fit between those two rotational positions.

It will be appreciated, for example, that the demand for packaging material at a load during relative rotation between the load and a packaging material dispenser may be predicted or determined in a number of manners, including based upon the dimensions and/or offset of a load within a plane that is orthogonal to an axis of rotation about which relative rotation occurs between a load and a packaging material dispenser, as well as based upon a number of different sensed characteristics. This demand may be used to determine a dispense rate that controls the rate at which packaging material is dispensed from the packaging material dispenser to apply a desired wrap force to the load by the packaging material during wrapping.

The dispense rate may be controlled, for example, based upon a wrap force parameter that controls the amount of wrap force applied to the load by the packaging material during wrapping. In some embodiments, the wrap force parameter may be specified in terms of a payout percentage, which refers to the amount in which the dispense rate of the packaging material is scaled relative to the predicted demand. A payout percentage of 100%, for example, corresponds to a dispense rate that substantially meets the predicted demand, whereas a payout percentage of 80% corresponds to a dispense rate that is 80% of the predicted demand, and a payout percentage of 120% corresponds to a dispense rate that is 120% of the predicted demand. In some embodiments, the predicted demand against which the payout percentage may be applied may correspond to a full revolution (i.e., a payout percentage of X % corresponds to dispensing X % of the predicted demand over a full revolution), while in other embodiments the payout percentage may represent a percentage of a predicted demand over only a portion of a revolution.

Thus, it will be appreciated that decreasing the payout percentage generally slows the rate at which packaging material exits the packaging material dispenser compared to the relative rotation of the load such that the packaging material is pulled tighter around the load, thereby increasing containment force. In contrast, increasing the payout percentage decreases the wrap force. For the purposes of simplifying the discussion hereinafter, however, a payout percentage of 100% is initially assumed. It will be appreciated also that other metrics may be used as an alternative to payout percentage to reflect the relative amount of wrap force to be applied during wrapping, so the invention is not so limited and a wrap force parameter may therefore be represented in manners other than payout percentage.

In various embodiments, curve fitting may be applied at different points in the calculation of a control signal to control dispense rate of a packaging material dispenser. In some embodiments, for example, curve fitting may be applied to generate a demand curve representing at least a portion of a revolution (e.g., over a range of rotational positions) between a load and packaging material dispenser about a center of rotation, and based upon fitting the curve to two or more points corresponding to predicted demands at two or more rotational positions. From such a demand curve, a wrap force parameter such as payout percentage may optionally be applied to generate a dispense rate curve over that range of rotational positions that is suitable for controlling the packaging material dispenser.

In other embodiments, curve fitting may be applied to generate a dispense rate curve representing at least a portion of a revolution (e.g., over a range of rotational positions) between a load and packaging material dispenser about a center of rotation, and based upon fitting the curve to two or more points corresponding to dispense rates calculated from predicted demands at two or more rotational positions. Put another way, the dispense rate for each of the rotational positions to which a curve is fit may be generated from a predicted demand for that rotational position, e.g., by scaling the predicted demand by a wrap force parameter such as payout percentage.

In both scenarios, the dispense rate for certain rotational positions (referred to for convenience herein as "demand positions") within a revolution will be based upon a predicted demand, while for other rotational positions between those for which the dispense rate is based upon a predicted demand (referred to for convenience herein as "fitted curve positions"), the dispense rate will be based upon a curve fit between two or more demand positions. As will become apparent below, at some fitted curve positions, the demand and/or dispense rate calculated therefrom may still be substantially equal to a predicted demand for that position and/or a dispense rate calculated therefrom simply due to the geometry of the fitted curve; however, at other fitted curve positions the demand and/or dispense rate calculated therefrom will generally depart from the predicted demand for that position and/or a dispense rate calculated therefrom. Thus, for at least a portion of the fitted curve positions within a range of rotational positions, the dispense rates calculated for those fitted curve positions will not equal the dispense rates that would have been calculated for those rotational positions based upon predicted demand.

It will also be appreciated that curve fitting may be applied in a number of different manners in different embodiments. For example, in some embodiments, curve fitting may be applied to generate a curve over a range of rotational positions that may span a portion of a revolution, a full revolution, or even multiple revolutions of a wrap cycle, and the curve may be accessed during a wrap cycle to determine a dispense rate at a particular rotational position during the wrap cycle.

In other embodiments, however, curve fitting may be dynamically performed in connection with determining the dispense rate for a particular rotational position, e.g., by determining a predicted demand at one or more earlier rotational positions and one or more later rotational positions relative to a current rotational positions, and then applying a function (e.g., a sine or other trigonometric function) to dynamically calculate a point on a curve that fits the predicted demands (or dispense rates corresponding thereto) for those earlier and later rotational positions. Put another way, references to "curve fitting" herein should not be considered to imply that a mapping or plotting operation is necessarily performed to explicitly draw a curve or curve segment over multiple rotational positions.

Figure 5:
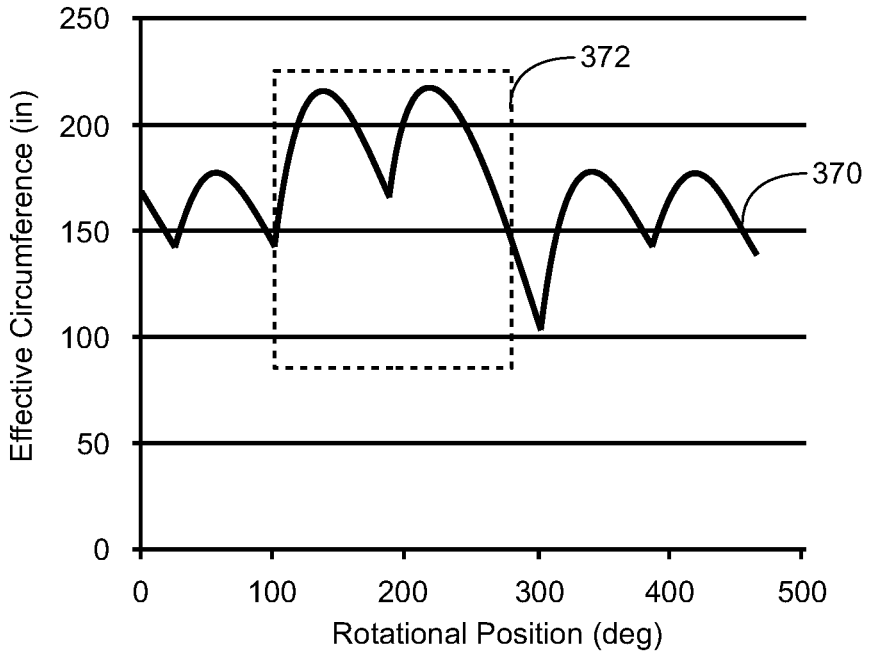
FIG. 5 illustrates a demand curve for an example load.

Now turning to FIG. 5, this figure illustrates an example graph 370 of effective circumference over a plurality of rotational positions angles for an example load with a 48 inch length, a 40 inch width, and an offset of 4 inches in length and 0 inches in width from the center of rotation. As will be discussed in greater detail below, effective circumference may be used in some embodiments as a proxy for demand, as effective circumference of a load throughout relative rotation is indicative of an effective consumption rate of the load, which is in turn indicative of the amount of packaging material being "consumed" by the load as the load rotates relative to the packaging dispenser. In particular, effective consumption rate, as used herein, generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load.

Graph 370 may therefore be considered to be a demand curve for some embodiments. A portion of demand curve 370 displayed in box 372 is illustrated in greater detail in FIG. 6, along with an example curve 374 fit onto a portion of demand curve 370.

Figure 6:
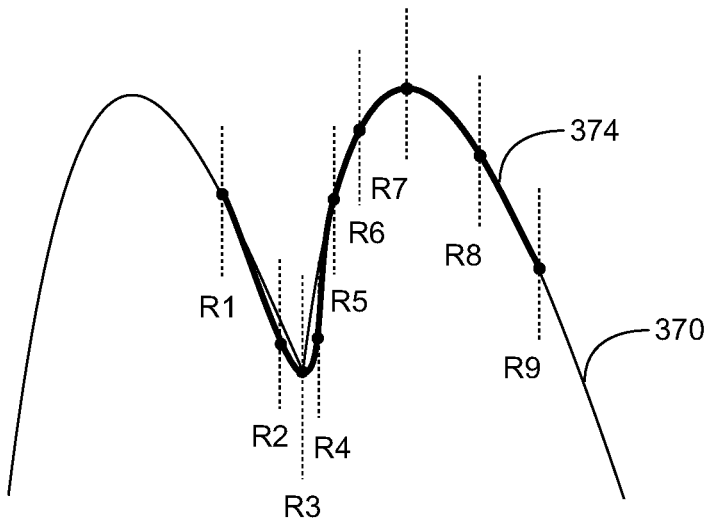
FIG. 6 illustrates a fitted curve superimposed on a portion of the demand curve of FIG. 5.

Also illustrated in FIG. 6 are a plurality of rotational positions denoted as rotational positions R1-R9. In this example, rotational positions R1, R3, R5, R7 and R9 are demand positions for which predicted demands at those rotational positions have been determined, and from which dispense rates may be calculated based upon those predicted demands. Rotational positions R2, R4, R6 and R8, on the other hand, are fitted curve positions where dispense rates may be calculated based upon values of the curve 374 at those rotational positions. These values may be referred to as demand values, although it will be appreciated that the values are not necessarily representative of the actual demand at those rotational positions.

As noted above, for these fitted curve positions, dispense rates may be calculated based upon a curve fit between two or more rotational positions for which predicted demands are determined. Thus, in the example of FIGS. 5 and 6, the dispense rates for fitted curve positions R2, R4, R6 and R8 may be determined based upon demand values on curve 374.

While in some embodiments curve 374 may be generated as a single curve fit to multiple demand positions, in the embodiment illustrated in FIGS. 5 and 6, curve 374 includes multiple segments that are individually fit to groups of demand positions. For example, in one embodiment curve 374 may include a segment fit between demand positions R1 and R3, a segment fit between demand positions R3 and R5, a segment fit between demand positions R5 and R7, and a segment fit between demand positions R7 and R9. In another embodiment, however, curve 374 may include segments fit between more than two demand positions, e.g., one segment fit between demand positions R1, R3 and R5, and another segment fit between demand positions R5, R7 and R9.

As was also noted above, calculated dispense rates for some fitted curve positions may substantially match the dispense rates that would have been calculated based upon predicted demand, should the fitted curve closely match the demand curve. Thus, for example, the demand values for rotational positions R6 and R8 are illustrated as substantially lying on the demand curve 370. However, at other fitted curve positions, the calculated dispense rates will not equal the dispense rates that would have been calculated for those rotational positions based upon predicted demand, and thus, the demand values for rotational positions R2 and R4 are illustrated as lying offset from the demand curve 370.

Predicted Demand

Figure 7:
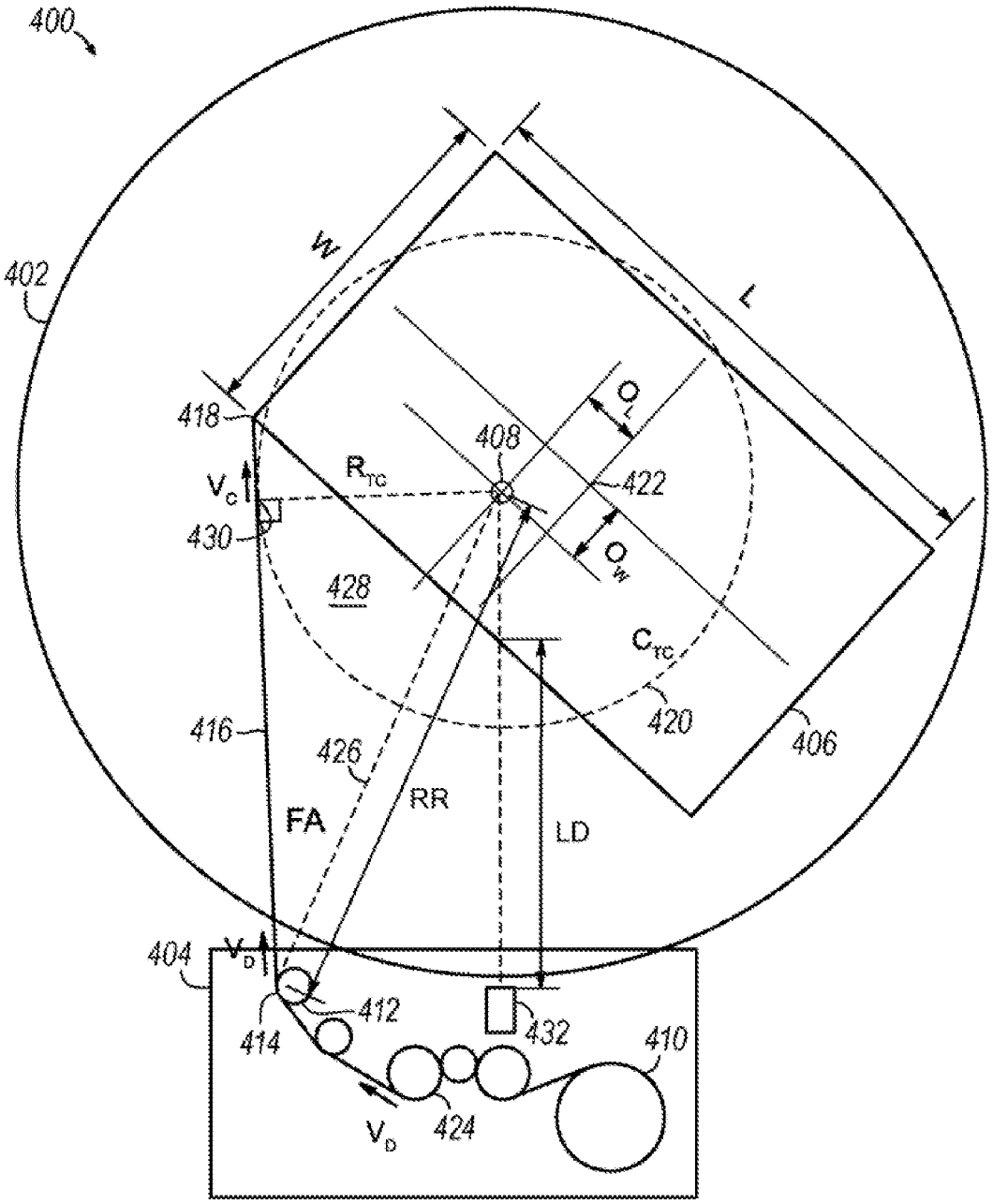
FIG. 7 is a top view of a packaging material dispenser and a load, illustrating a tangent circle defined for the load throughout relative rotation between the packaging material dispenser and the load.

Now turning to FIG. 7, as noted above, demand may be predicted in a number of different manners in different embodiments. In some embodiments, for example, demand may be predicted based upon a geometric relationship between a packaging material dispenser and corners of the load, e.g., based upon effective circumference as disclosed in U.S. Pat. Nos. 9,932,137, 10,005,580 and 10,005,581, which are incorporated by reference herein.

FIG. 7, for example, functionally illustrates a wrapping apparatus 400 in which a load support 402 and packaging material dispenser 404 are adapted for relative rotation with one another to rotate a load 406 about a center of rotation 408 and thereby dispense a packaging material 410 for wrapping around the load. In this illustration, the relative rotation is in a clockwise direction relative to the load (i.e., the load rotates clockwise relative to the packaging material dispenser, while the packaging material dispenser may be considered to rotate in a counter-clockwise direction around the load). As mentioned above, the effective circumference of a load throughout relative rotation is indicative of an effective consumption rate of the load, which generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load, and thus, in FIG. 7, an idle roller 412 defines an exit point 414 for packaging material dispenser 404, such that a portion of web 416 of packaging material 410 extends between this exit point 414 and an engagement point 418 at which the packaging material 410 engages load 406. In this arrangement, a tangent circle 420 is tangent to portion 416 and is centered at center of rotation 408.

The tangent circle has a circumference $C_{TC}$, which may be considered to be the "effective circumference" of the load. Likewise, other dimensions of the tangent circle, e.g., the radius $R_{TC}$ and diameter $D_{TC}$, may be respectively referred to as the "effective radius" and "effective diameter" of the load.

It has been found that for a load having a non-circular cross-section, as the load rotates relative to the dispenser about center of rotation 408, the size (i.e., the circumference, radius and diameter) of tangent circle 420 dynamically varies, and that the size of tangent circle 420 throughout the rotation effectively models, at any given angular position of the load relative to the dispenser, a rate at which packaging material should be dispensed in order to match the consumption rate of the load, i.e., where the dispense rate in terms of linear velocity (represented by arrow $V_D$) is substantially equal to the tangential velocity of the tangent circle (represented by arrow $V_C$). Thus, in situations where a payout percentage of 100% is desired, the desired dispense rate of the packaging material may be set to substantially track the dynamically changing tangential velocity of the tangent circle, and thus the predicted demand.

Of note, the tangent circle is dependent not only on the dimensions of the load (i.e., the length L and width W), but also the offset of the geometric center 422 of the load from the center of rotation 408, illustrated in FIG. 7 as $O_L$ and $O_W$. Given that in many applications, a load will not be perfectly centered when it is placed or conveyed onto the load support, the dimensions of the load, by themselves, typically do not present a complete picture of the effective consumption rate of the load. Nonetheless, as will become more apparent below, the calculation of the dimensions of the tangent circle, and thus the effective consumption rate, may be determined without determining the actual dimensions and/or offset of the load in many embodiments.

It has been found that this tangent circle, when coupled with the web of packaging material and the drive roller (e.g., drive roller 424), functions in much the same manner as a belt drive system, with tangent circle 420 functioning as the driver pulley, dispenser drive roller 424 functioning as the follower pulley, and web 416 of packaging material functioning as the belt. For example, let $N_d$ be the rotational velocity of a driver pulley in RPM, $N_f$ be the rotational velocity of a follower pulley in RPM, $R_d$ be the radius of the driver pulley and $R_f$ be the radius of the follower pulley. Consider the length of belt that passes over each of the driver pulley and the follower pulley in one minute, which is equal to the circumference of the respective pulley (diameter *π, or radius *2π) multiplied by the rotational velocity:

$$L_d=2\pi*R_d*N_d \tag{1}$$

$$L_f=2\pi*R_f*N_f \tag{2}$$

where $L_d$ is the length of belt that passes over the driver pulley in one minute, and $L_f$ is the length of belt that passes over the follower pulley in one minute.

In this theoretical system, the point at which neither pulley applied a tensile or compressive force to the belt (which generally corresponds to a payout percentage of 100%) would be achieved when the tangential velocities, i.e., the linear velocities at the surfaces or rims of the pulleys, were equal. Put another way, when the length of belt that passes over each pulley over the same time period is equal, i.e., $L_d=L_f$. Therefore:

$$2\pi R_d*N_d=2\pi*R_f*N_f \tag{3}$$

Consequently, the velocity ratio VR of the rotational velocities of the driver and follower pulleys is:

$$VR=\frac{N_d}{N_f}=\frac{R_f}{R_d} \tag{4}$$

Alternatively, the velocity ratio may be expressed in terms of the ratio of diameters or of circumferences:

$$VR=\frac{N_d}{N_f}=\frac{D_f}{D_d} \tag{5}$$

-continued $$VR = \frac{N_d}{N_f} = \frac{C_f}{C_d} \tag{6}$$

where $D_f$, $D_d$ are the respective diameters of the follower and driver pulleys, and $C_f$, $C_d$ are the respective circumferences of the follower and driver pulleys.

Returning to equations (1) and (2) above, the values $L_d$ and $L_f$ represent the length of belt that passes the driver and follower pulleys in one minute. Thus, when the tangent circle for the load is considered a driver pulley, the effective consumption rate (ECR) may be considered to be equal to the length of packaging material that passes the tangent circle in a fixed amount of time, e.g., per minute:

$$ECR=C_{TC}*N_{TC}=2\pi*R_{TC}*N_{TC} \tag{7}$$

where $C_{TC}$ is the circumference of the tangent circle, $N_{TC}$ is the rotational velocity of the tangent circle (e.g., in revolutions per minute (RPM)), and $R_{TC}$ is the radius of the tangent circle.

Therefore, given a known rotational velocity for the load, a known circumference of the tangent circle at a given instant and a known circumference for the drive roller, the rotational velocity of the drive roller necessary to provide a dispense rate that substantially matches the effective consumption rate is:

$$N_{DR} = \frac{C_{TC}}{C_{DR}} * N_L \tag{8}$$

where $N_{DR}$ is the rotational rate of the drive roller, $C_{TC}$ is the circumference of the tangent circle and the effective circumference of the load, $C_{DR}$ is the circumference of the drive roller and NL is the rotational rate of the load relative to the dispenser.

In addition, should it be desirable to scale the rotational rate of the drive roller to provide a controlled payout percentage (PP), and thereby provide a desired containment force and/or a desired packaging material use efficiency, equation (8) may be modified as follows:

$$N_{DR} = \frac{C_{TC}}{C_{DR}} * N_L * PP \tag{9}$$

Figure 8:
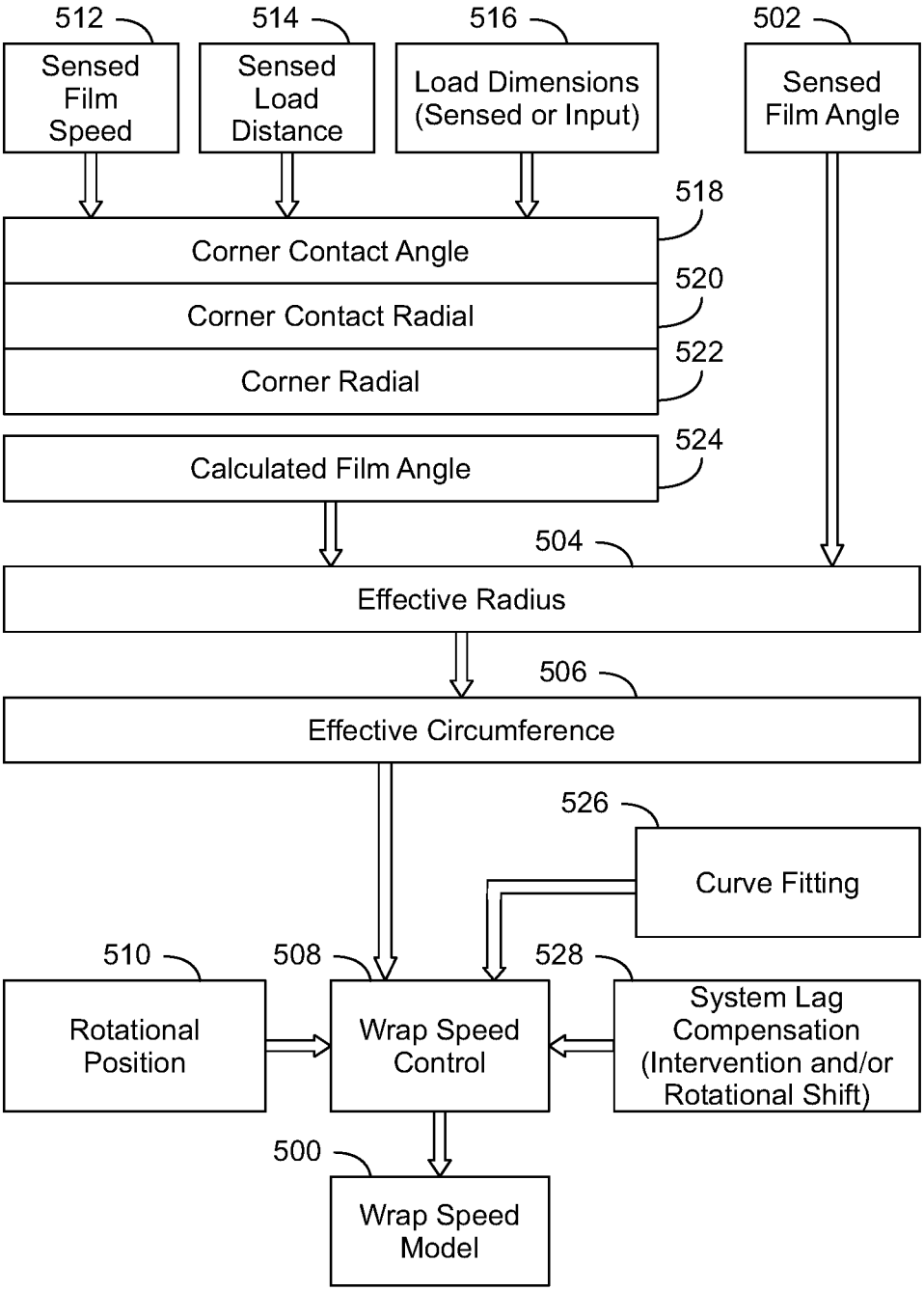
FIG. 8 is a block diagram of various inputs to a wrap speed model consistent with the invention.

The manner in which the dimensions (i.e., circumference, diameter and/or radius) of the tangent circle may be calculated or otherwise determined in order to model predicted demand may also vary in different embodiments. For example, as illustrated in FIG. 8, a wrap speed model 500, representing the control algorithm by which to drive a packaging material dispenser to dispense packaging material at a desired dispense rate during relative rotation with a load, may be responsive to a number of different control inputs.

In some embodiments, for example, a sensed film angle (block 502) may be used to determine various dimensions of a tangent circle, e.g., effective radius (block 504) and/or effective circumference (block 506). As shown in FIG. 7, for example, a film angle FA may be defined as the angle at exit point 414 between portion 416 of packaging material 410 (to which tangent circle 420 is tangent) and a radial or radius 426 extending from center of rotation 408 to exit point 414.

Returning to FIG. 8, the film angle sensed in block 502, e.g., using an encoder and follower arm or other electronic sensor, is used to determine one or more dimensions of the tangent circle (e.g., effective radius, effective circumference and/or effective diameter), and from these determined dimensions, a wrap speed control algorithm 508 determines a dispense rate. In many embodiments, wrap speed control algorithm 508 also utilizes the angular relationship between the load and the packaging material dispenser, i.e., the sensed rotational position of the load 510, as an input such that, for any given rotational position or angle of the load (e.g., at any of a plurality of angles defined in a full revolution), a desired dispense rate for the determined tangent circle may be determined.

Alternatively or in addition to the use of sensed film angle, various additional inputs may be used to determine dimensions of a tangent circle. As shown in block 512, for example, a film speed sensor, such as an optical or magnetic encoder on an idle roller, may be used to determine the speed of the packaging material as the packaging material exits the packaging material dispenser. In addition, as shown in block 514, a laser or other distance sensor may be used to determine a load distance (i.e., the distance between the surface of the load at a particular rotational position and a reference point about the periphery of the load). Furthermore, as shown in block 516, the dimensions of the load, e.g., length, width and/or offset, may either be input manually by a user, may be received from a database or other electronic data source, or may be sensed or measured.

From any or all of these inputs, one or more dimensions of the load, such as corner contact angles (block 518), corner contact radials (block 520), and/or corner radials (block 522) may be used to determine a calculated film angle (block 524), such that this calculated film angle may be used in lieu of or in addition to any sensed film angle to determine one or more dimensions of the tangent circle. Thus, the calculated film angle may be used by the wrap speed control algorithm in a similar manner to the sensed film angle described above.

Wrap speed control algorithm 508 may also employ curve fitting logic 526 as described above to control a dispense rate for at least a portion of the rotational positions using a curve fit between multiple rotational positions from which predicted demand has or can be calculated.

Moreover, as will be discussed in greater detail below, in some embodiments additional modifications may be applied to wrap speed control algorithm 508 to provide more accurate control over the dispense rate. As shown in block 528, for example, a compensation may be performed to address system lag. In some embodiments, for example, a controlled intervention may be performed to effectively anticipate contact of a corner of the load with the packaging material. In addition, in some embodiments, a rotational shift may be performed to better align collected data with the control algorithm and thereby account for various lags in the system.

Returning to FIG. 7, when sensed film angle is used to determine predicted demand, effective circumference may be determined based upon the right triangle 428 defined by center of rotation 408, exit point 414, and a tangent point 430 where web 416 of packaging material 410 intersects with tangent circle 420. Given that an effective radius $R_{TC}$ extending between center of rotation 408 and point 430 forms a right angle with web 416, and further given that the length of the rotation radial (RR), i.e., the radius 426 from center of rotation 408 to exit point 414, is known, the effective radius $R_{TC}$ may be calculated using the film angle (FA) and length RR as follows:

$$R_{TC}=RR*\sin(FA) \tag{10}$$

Furthermore, the effective circumference $C_{TC}$ may be calculated from the effective radius as follows:

$$C_{TC}=2\pi*R_{TC}=2\pi*RR*\sin(FA) \quad (11)$$

In some embodiments, exit point 414 is defined at a fixed point proximate idle roller 412, e.g., proximate a tangent point at which web 416 disengages from idle roller 412 when web 416 is about half-way between the maximum and minimum film angles through which the web passes for a particular load, or alternatively, for all expected loads that may be wrapped by wrapping apparatus 400. Alternatively, exit point 414 may be defined at practically any other point along the surface of idle roller 412, or even at the center of rotation thereof. In other embodiments, however, it may be desirable to dynamically determine the exit point based on the angle at which web 416 exits the dispenser. Other dynamically or statically-defined exit points proximate the packaging material dispenser may be used in other embodiments consistent with the invention.

Film angle may be sensed in a number of manners consistent with the invention, e.g., using a distance sensor that measures distance between the plane of the web of packaging material and the fixed location of the sensor, using a cantilevered or rockered follower arm that rides along the surface of a web, using a force sensor that senses force changes resulting from movement of the web through a range of film angles, using a light curtain or other sensor array, or in other manners that will be appreciated by those of ordinary skill in the art.

Figure 9:
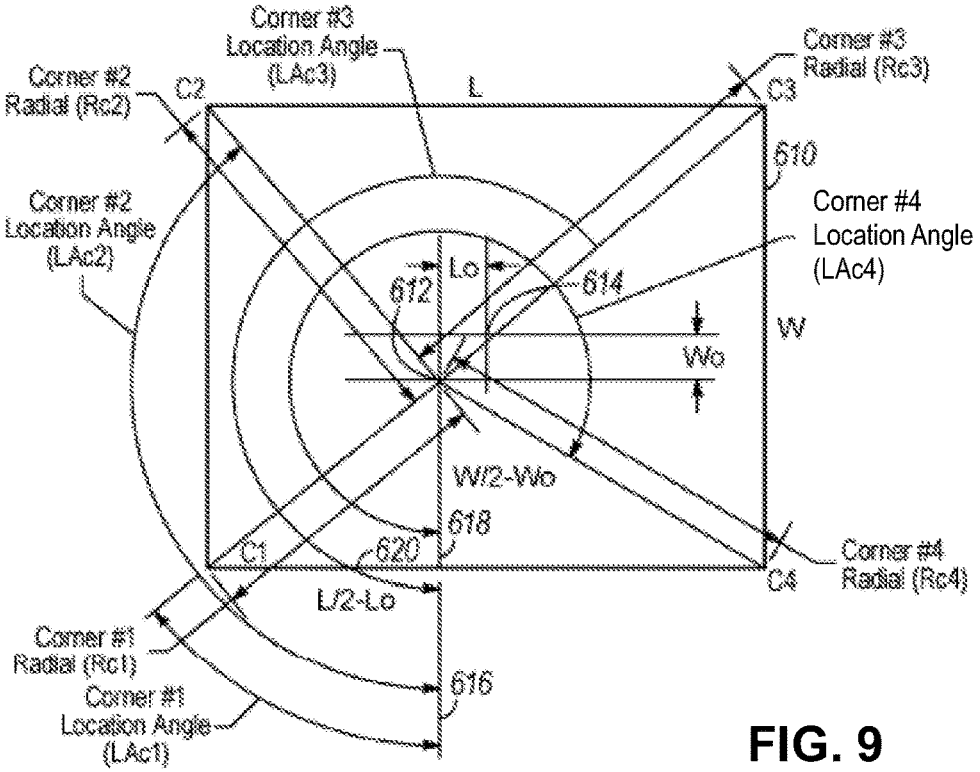
FIG. 9 illustrates various dimensions and angles defined on an example load.

When load dimensions are used to determine predicted demand, an effective consumption rate may be determined in part based on the dimensions and offset of a load, which may be determined using the locations of the corners of the load. For example, as shown in FIG. 9, an example load 610 of length L and width W, and having four corners denoted C1, C2, C3 and C4, may be considered to have four corner radials Rc1, Rc2, Rc3 and Rc4 extending from a center of rotation 612 to each respective corner. The load has a geometric center 614 that is offset along the length and width as represented by Lo and Wo.

The location of each corner may be defined, for example, using polar coordinates for each of the corner radials, defining both a length (RcX, where X=1, 2, 3, or 4) and an angle (referred to as a corner location angle, LAcX) relative to a base angular position, such as defined at 616. Alternatively, Cartesian coordinates may be used. The length and the width of the load may be determined using the corner radial locations, for example, by applying the law of cosines to the triangles formed by the corner radials and the outer dimensions of the load. Furthermore, to determine the corner location angle for the corner radials, the orthogonal distances from the center of rotation to the sides of the rectangle may be used to define a right triangle with the corner radial as the hypotenuse. As shown in FIG. 9, for example, for corner radial Rc1, a right triangle is defined between the corner radial and line segments 618, 620, and it will be appreciated that the corner location angle LAc1 may be determined in a number of manners, e.g., by taking the arcsine of the ratio of segment 620 and the corner radial Rc1. Then, based on the locations of the corner radials, the film angle at any rotational position of the load may be determined, e.g., as described in the aforementioned cross-referenced patents.

Figure 10:
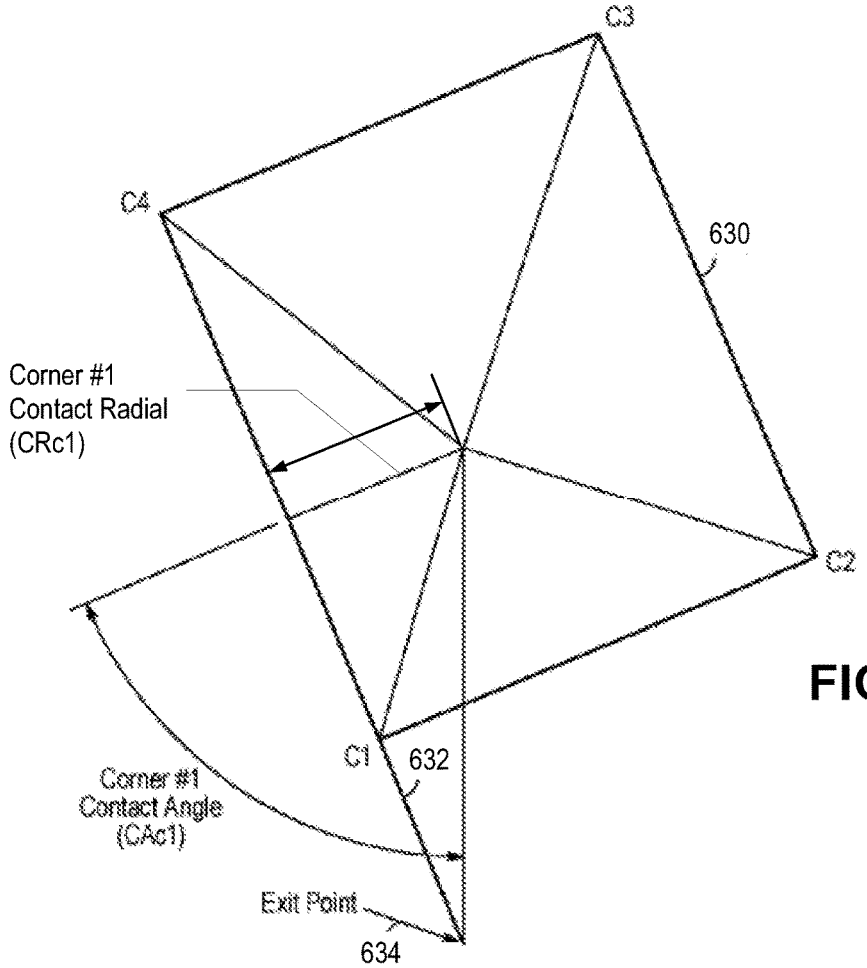
FIG. 10 illustrates various dimensions and angles defined on another example load and used to determine a contact angle for a corner.

In addition, corner contact radials may also be used to determine predicted demand. FIG. 10, for example, illustrates an example load 630 including corners C1-C4 with a web 632 of packaging material extending between load 630 and an exit point 634. Of note, the figure illustrates the moment in which contact occurs between web 632 with corner C1, after having previously been extending between corner C4 to exit point 634. A corner contact radial CRc1 extends from the center of rotation to the surface of web 632, and substantially perpendicular thereto. The corner contact angle for the corner contact radial CRc1 is illustrated at CAc1, and represents a position relative to a home position where web 632 first contacts corner C1.

Corner contact radials may be geometrically derived from load dimensions, corner radials, etc., as will be appreciated by those of ordinary skill having the benefit of the instant disclosure. Further, corner contact is also associated with a local minimum in effective circumference, and thus predicted demand, so corner contact radials may also be determined based upon sensed film speed or load distance.

To correlate film speed to dimensions of a load, for example, the amplitudes of the local minimums and maximums of the film speed, or alternatively, the local minimums and maximums of the rotational velocity of an idle roller, may be used. In general, the amplitude of the peak, or maximum, speed after a corner passes approximates the length of its corner radial, while the amplitude of the minimum speed where a corner passes approximates the length of its corner contact radial, which is typically the effective radius of the load at corner contact. The angle where the peak or maximum speed occurs after a corner passes approximates the corner location angle where the length of the corner radial and the effective radius are approximately equal, and the angle where the minimum speed occurs after a corner passes approximates the contact angle for that corner.

Likewise, in some embodiments, a load distance sensor may be used to determine film angle, and thus, effective circumference and/or effective consumption rate. A load distance sensor, for example, may be oriented along a radius from the center of rotation and at a known and fixed distance from and angular position about the center of rotation. By orienting this sensor such that a corner passes the sensor prior to engaging the packaging material, both the length and the corner contact angle of the corner radial may be determined prior to contact with the packaging material, and used to determine predicted demand through the phase of the rotation in which the web of packaging material extends between the corner and the exit point of the dispenser.

Alternatively, a load distance sensor may be used to determine a complete geometric profile of a load, e.g., through an initial full revolution in which the distance to the surface of the load is stored and used to derive the length, width and offset of the load and/or the locations of each of the corners. In addition, given that some loads may have varying dimensions from top to bottom, it may be desirable in some embodiments to record the output of the load distance sensor during each revolution for use in determining the dimensions of the load to be used for the subsequent revolution (or for multiple subsequent revolutions). Derivation of corner locations (e.g., corner radials and corner location angles) from the determined dimensions and offset of the load may then be performed in the manner discussed above in some embodiments.

In addition, in some embodiments of the invention, a wrap speed model and wrap speed control utilizing such a wrap speed model may be based at least in part on rotation angles associated with one or more corners of a load when determining predicted demand. In this regard, a corner rotation angle may be considered to include an angle or rotational position about a center of rotation that is relative to or otherwise associated with a particular corner of a load. In some embodiments, for example, a corner rotation angle may be based on a corner location angle for a corner, and represent the angular position of a corner radial relative to a particular base or home position (e.g., for corner C1 of load 610 of FIG. 9, the corner radial is Rc1 and the corner location angle is LAc1). Alternatively, a corner rotation angle may be based on a corner contact angle for a corner contact radial, representing an angle at which packaging material first comes into contact with a corner during relative rotation between the load and a packaging material dispenser (e.g., for corner C1 of load 630 of FIG. 10, the corner contact radial is CRc1 and the corner contact angle is CAc1). Given that these and other angles are geometrically related to one another based on the geometry of the load, it will be appreciated that a corner rotation angle consistent with the invention is not limited to only a corner location angle or a corner contact angle, and that other angles relative to or otherwise associated with a corner may be used in the alternative.

Corner rotation angles may be used in connection with wrap speed control in a number of manners consistent with the invention, in addition to use in connection with determining predicted demand. For example, in some embodiments, corner rotation angles may be used to determine to what corner the packaging material is currently engaging, and thus, what corner is effectively "driving" the effective consumption rate or predicted demand of the load. In this regard, in some embodiments, multiple corners may be tracked to enable a determination to be made as to when to switch from a current corner to a next corner when determining predicted demand and/or controlling dispense rate. In other embodiments, corner rotation angles may be used to anticipate corner contacts and perform controlled interventions, and in still other embodiments, corner rotation angles may be used in the performance of rotational data shifts. Corner rotation angles may also be used in connection with curve fitting, as will become more apparent below.

In some embodiments of the invention, for example, it may be desirable to determine and/or predict or anticipate a rotation angle such as a contact angle of each corner of a load during the relative rotation. In some embodiments, a contact angle, representing the rotational position of the load when the packaging material first contacts a particular corner, may be determined for each corner.

The contact angles may be sensed using various sensors discussed above, or determined via calculation based on the dimensions/offset of the load and/or corner locations. In addition, the contact angles may be used to effectively determine what corner is driving the wrap speed model, and thus, what corner profile should be used to control dispense rate.

Figure 11:
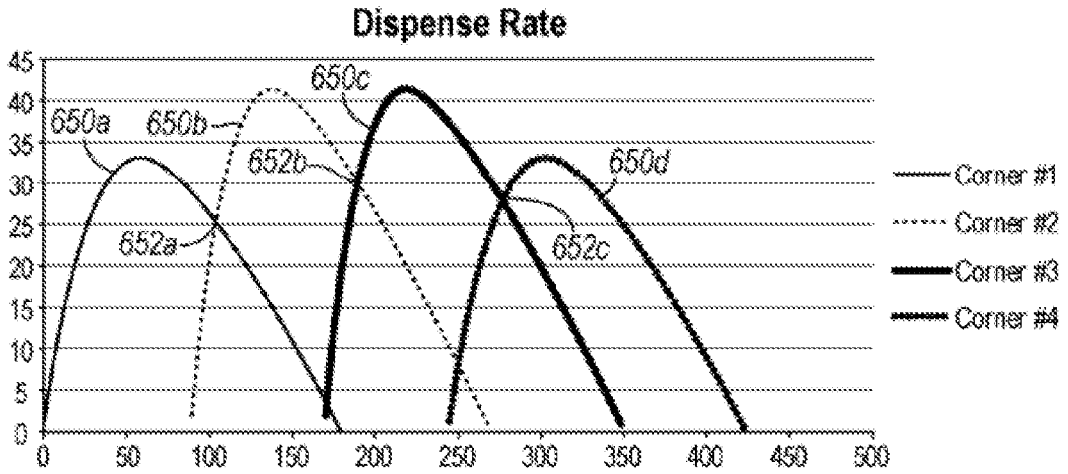
FIG. 11 illustrates a graph of dispense rates for four corners of a load.

FIG. 11, for example, illustrates a graph of the ideal dispense rates for corner profiles 650*a*, 650*b*, 650*c* and 650*d* for the four corners of an example load. It should be noted that the intersections of these profiles, at 652*a*, 652*b* and 652*c*, represent the contact angles when the packaging material, which is being driven by one corner, contacts the next corner such that the next corner begins to drive the desired dispense rate of the packaging material. Comparing FIG. 11 to FIG. 5 it may be seen that the effective circumference generally tracks these profiles and contact angles, and as such, in some embodiments, the contact angles may be sensed using a number of the aforementioned sensors.

For example, each of a film angle sensor and a load distance sensor will reach a local minimum proximate each contact angle. Thus, a wrap speed control may be configured to switch from one corner to a next corner based on the anticipated rotational position of each corner as sensed in either of these manners. As another example, an effective radius or effective circumference may be calculated based upon a current corner and a next corner, such that the contact angle is determined at the angle where the effective radius/effective circumference of the next corner becomes larger than that of the current corner. Alternatively, the contact angles may be calculated based on the dimensions of the load, in the general manner described above.

The contact angle of each corner may therefore be determined and used to select which corner is currently "driving" the dispensing process, based upon the known angular relationship of the load to the packaging material dispenser at any given time. In addition, the contact angle may be used to anticipate a contact of the packaging material with a corner so that, for example, a controlled intervention may be performed.

It will be appreciated that other trigonometric formulas and rules may be utilized to derive various dimensions and angles utilized herein to determine effective consumption rate and/or predicted demand without departing from the spirit and scope of the invention.

Furthermore, in some embodiments, predicted demand may be determined based upon sensed tension in a web of packaging material, e.g., based upon a load cell coupled to a roller or another tension feedback device utilized in tension-based stretch wrapping machines. While such embodiments may not incorporate the calculation of actual dimensions or other geometric aspects of a load, curve fitting may still be used in connection with sensed tension to control a dispense rate that, for at least a portion of the rotational positions of a load, is based upon a curve that departs from a predicted demand based on the sensed tension. Therefore, the invention is not limited to embodiments where predicted demand is based upon geometric calculations associated with a load.

Wrapping Operation

Returning briefly to FIG. 8, implementation of a wrap speed model 500 using any of the aforementioned techniques may be used to wrap packaging material around a load during relative rotation between the load and a packaging material dispenser. During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. Thereafter, wrapping continues while a lift assembly controls the height of the packaging material so that the packaging material is wrapped in a spiral manner around the load from the base of the load to the top. Multiple layers of packaging material may be wrapped around the load over multiple passes to increase containment force, and once the desired amount of packaging material is dispensed, the packaging material is severed to complete the wrap.

Based upon the various techniques discussed above, the manner in which the dispense rate is controlled during this operation may vary in different embodiments. For example, in some embodiments, an initial revolution may be performed to determine the dimensions of the load, such that corner locations may be determined prior to wrapping and then wrapping may commence using these predetermine corner locations to determine predicted demand. In other embodiments, no initial revolution may be performed, and either dimensions of the load as input or retrieved from a database may be used to determine predicted demand. In still other embodiments, sensed film angle, sensed film speed, sensed load distance, etc. may be used to calculate predicted demand as soon as wrapping is commenced.

Furthermore, as noted above, some loads may not have a consistent length and width from top to bottom. Loads may include different layers of objects or containers having different lengths and/or widths, and some layers may be offset relative to other layers. As such, it may be desirable in some embodiments to recalculate load dimensions and/or corner locations for different elevations on a load. For example, in some embodiments, as each corner approaches and/or passes the packaging material dispenser, the location of the corner may be recalculated and used for the next pass of the same corner. In some embodiments, load dimensions calculated during one full revolution may be used for the next full revolution, such that as the lift assembly changes the elevation of the packaging material dispenser, the load dimensions are dynamically updated based on the dimensions sensed at a particular elevation of the packaging material dispenser.

Figure 13:
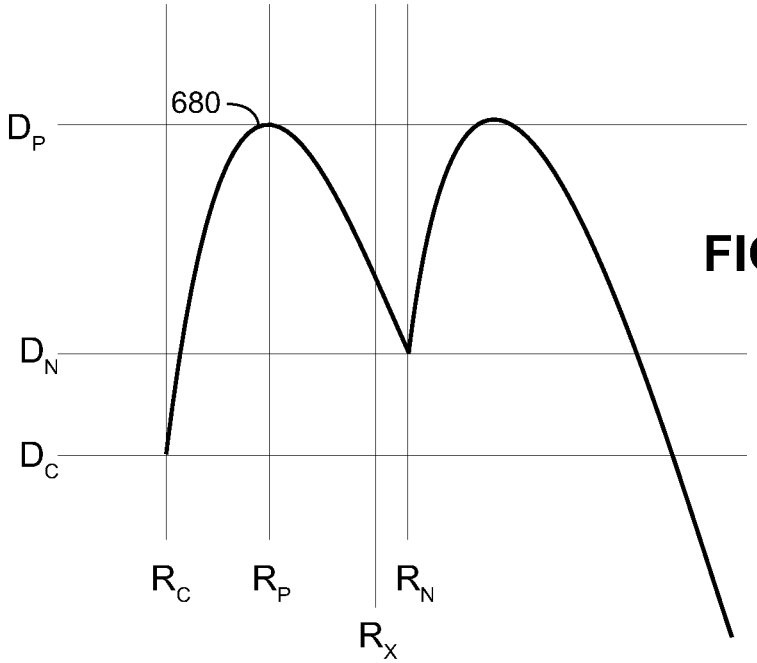
FIG. 13 illustrates various points on a portion of the demand curve of FIG. 5.
Figure 12:
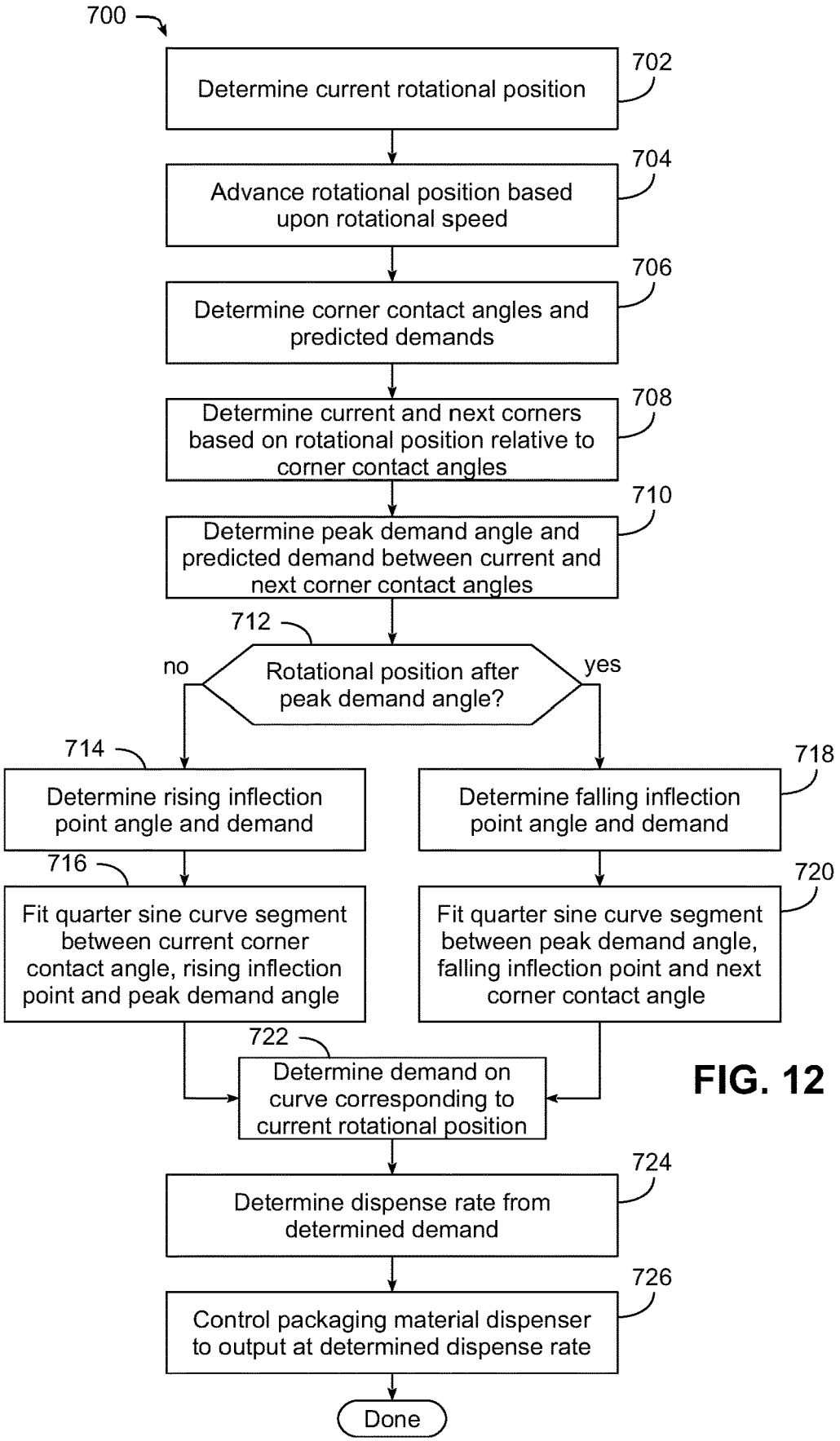
FIG. 12 is a flowchart illustrating an example sequence of operations for determining and controlling a dispense rate of a packaging material dispenser consistent with the invention.

Now turning to FIG. 12, and with additional reference to FIGS. 13-17, an example sequence of operations 700 is illustrated for controlling a packaging material dispenser to dispense at a dispense rate calculated based upon the herein-described techniques. In addition, to facilitate a further understanding of the herein-described techniques, FIG. 13 illustrates at 680 a portion of demand curve 370 illustrated in FIGS. 5-6, with a horizontal axis representing rotational position and a vertical axis representing predicted demand.

For the purposes of this example implementation, the determination of a demand for a rotational position Rx is described, and a number of values used in the determination of this demand are illustrated in FIG. 13. In particular, for the rotational position $R_X$, the predicted demands for both a current corner (i.e., the corner between which the web of packaging material is currently engaging) and/or the next corner (i.e., the next corner that will engage the web of packaging material after further rotation between the load and the packaging material dispenser, as well as the predicted demand for a peak demand angle between the current and next corners, may be used. As noted above, the corner contact angles are local minimums in demand, while the peak demand angle is a local maximum in demand.

Figure 14:
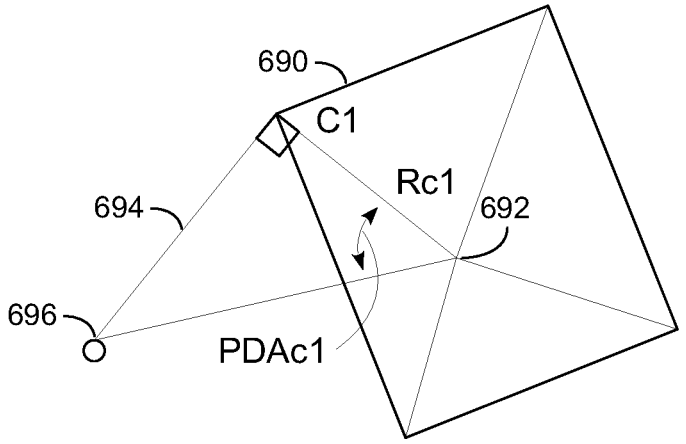
FIG. 14 illustrates various dimensions and angles defined on an example load and used to determine a peak demand angle.

Further, in the example implementation, the peak demand angle is located at the rotational position where the corner radial for the current corner forms about a 90 degree angle with the web of packaging material. As shown in FIG. 14, for example, for a corner C1 of a load 690 that rotates about a center of rotation 692, the peak demand angle (e.g., PDAc1 when rotational position is defined relative to a line extending between center of rotation 692 and exit point 696) occurs when the corner radial for that corner, Rc1, forms a 90 degree angle with web 694 extending between corner C1 and exit point 696. Moreover, it will be appreciated that the effective circumference at the peak demand angle will be based upon an effective radius that is equal to the length of the corner radial Rc1 at this point. Thus, in this example the peak demand at the peak demand angle is $2\pi$*Rc1.

Thus, for the current corner, the corner contact angle is denoted in FIG. 13 as $R_C$ and the predicted demand at that corner contact angle is denoted as $D_C$. Likewise, for the next corner, the corner contact angle is denoted as $R_N$ and the predicted demand at that corner contact angle is denoted as $D_N$. The peak demand angle is denoted as $R_P$ and the predicted demand at that angle is denoted as $D_P$.

Now returning to FIG. 12, sequence 700 is used to dynamically calculate and control a dispense rate for a current rotational position of a load relative to a packaging material dispenser. Sequence 700 may be executed, for example, within a controller of a stretch wrapping machine, e.g., controller 170 of FIG. 2, although in other embodiments some or all of the operations performed in sequence 700 may be performed remote from a stretch wrapping machine, e.g., within a server, cloud-based service, a mobile device, etc.

Each iteration of sequence 700 specifically determines a dispense rate for a particular rotational position, which is determined in block 702. The rotational position may be determined, for example, based upon a signal provided by an angle sensor (e.g., angle sensor 152), and represents a current rotational position of the load relative to the packaging material dispenser.

Next, in block 704, in some embodiments a rotational data shift may be performed to offset system lag. In particular, as mentioned above, it may be desirable in some embodiments to account for system lags through the use of a rotational shift of the data utilized by a wrap speed model. From an electronic standpoint, delays due to the response times of sensors and drive motors, communication delays, and computational delays in a controller will necessarily introduce some amount of lag. Moreover, from a physical or mechanical standpoint, sensors may have delays in determining a sensed value and drive motors, such as the motor(s) used to drive a packaging dispenser, as well as the other rotating components in the packaging material, typically have rotational inertia to overcome whenever the dispense rate is changed. Furthermore, packaging material typically has some degree of elasticity even after prestretching, so some lag will exist before changes in dispense rate propagate through the web of packaging material. In addition, mechanical sources of fluctuation, such as film slippage on idle rollers, out of round rollers and bearings, imperfect mechanical linkages, flywheel effects of downstream non-driven rollers, may also exist. These delays can therefore introduce a system lag, such that a desired dispense rate at a particular rotational position of the load, as calculated by a wrap speed model, will not occur at the load until after some duration of time or further angular rotation.

To address this issue, a rotational shift may be applied to the sensed data used by the wrap speed model or to the calculated dimensions or position of the load, which in either case has the net effect of advancing the wrap speed model to an earlier point in time or rotational position such that the actual dispense rate at the load will more closely line up with that calculated by the wrap speed model, thereby aligning the phase of the profile of the actual dispense rate with that of the desired dispense rate calculated by the wrap speed model.

In some embodiments, the system lag from which the rotational shift may be calculated may be a fixed value determined empirically for a particular wrapping apparatus. In other embodiments, the system lag may have both fixed and variable components, and as such, may be derived based upon one or more operating conditions of the wrapping apparatus. For example, a controller may have a fairly repeatable electronic delay associated with computational and communication costs, which may be assumed in many instances to be a fixed delay. In contrast, the rotational inertia of packaging material dispenser components, different packaging material thicknesses and compositions, and the wrapping speed (e.g., in terms of revolutions per minute of the load) may contribute variable delays depending upon the current operating condition of a wrapping apparatus. As such, in some embodiments, the system lag may be empirically determined or may be calculated as a function of one or more operating characteristics. In the embodiments discussed hereinafter, for example, the system lag may be calculated as a function of the current rotational speed (i.e., rate of relative rotation between the load and the packaging material dispenser).

Rotational shifts may also be applied in other manners consistent with the invention. For example, through positioning of a sensor such as a load distance sensor at an earlier rotational position, e.g., shifted a few degrees in advance of a base or home position, the sensor data may be treated as if it were collected at the base or home position to apply a rotational shift to the model. In addition, rather than performing a rotational shift by advancing the rotational position as is performed in block 704, the demand curve may be shifted. In other embodiments, no rotational shift may be performed, and block 704 may be omitted.

Next, in block 706 corner contact angles may be determined for one or more of the corners of the load based upon the geometry of the load, along with predicted demands at each of those corner contact angles. The corner contact angles and predicted demands therefor may be determined in any of the various manners discussed above, e.g., based upon sensed or input load dimensions and offset, or in other manners of sensing predicted demand as discussed above. Corner contact angles may be determined based upon local minimums in sensed predicted demand in some embodiments, and may be based in some embodiments on sensor data collected during earlier relative revolutions. In addition, corner contact angles may be determined in block 706 in some embodiments for only a subset of the corners of the load (e.g., a current and/or next corner of the load), or for all corners, and in some embodiments, the corner contact angles and/or the predicted demands therefor may be calculated and stored, whereby the determinations in block 706 may include the retrieval of previously calculated values (e.g., as may be determined prior to commencing a wrapping operation, during an earlier relative revolution, etc.).

Next, in block 708, current and next corners are determined, e.g., by comparing the current rotational position to the corner contact angles of each corner to determine what corner is currently engaged by the packaging material and what corner will be the next corner to be engaged. Then, in block 710, a peak demand angle and predicted demand therefor is determined for the point of peak demand between the current and next corners. In some embodiments, these values may be determined based upon load geometry and in the manner discussed above. In other embodiments, these values may be determined via sensing, e.g., by sensing a local maximum in demand during a prior relative revolution. In addition, as with the corner contact angles and predicted demands therefor, these values may be determined at various times, e.g., prior to commencing wrapping, during an earlier relative revolution, during the current relative revolution, etc.

Block 712 next determines whether the current rotational position is before or after the peak demand angle, thereby indicating whether the demand is increasing or decreasing. In the illustrated embodiment, a quarter sine curve, i.e., a curve representative of one fourth of the period of a sinusoidal function (e.g., 90 degrees of a 360 degree sinusoidal function), is fit between the peak demand angle and the corner contact angle for either the current corner or the next corner, with block 712 effectively selecting between the corner contact angle for the current corner and the corner contact angle for the next corner with which to fit the curve. When prior to the peak demand angle, the corner contact angle for the current corner is used as one endpoint and the peak demand angle is used as another endpoint, with a third, intermediate point referred to herein as a rising inflection point additionally used in the curve fitting operation. Conversely, when after the peak demand angle, the corner contact angle for the peak demand angle is used as one endpoint and the corner contact angle for the next corner is used as another endpoint, with a third, intermediate point referred to herein as a falling inflection point additionally used in the curve fitting operation. Thus, in the illustrated embodiment, each quarter sine curve generally represents a portion of a sinusoidal function between a peak (a point of maximum amplitude) and a trough (a point of minimum amplitude), or conversely, between a trough and a peak, although the invention is not so limited.

Figure 15:
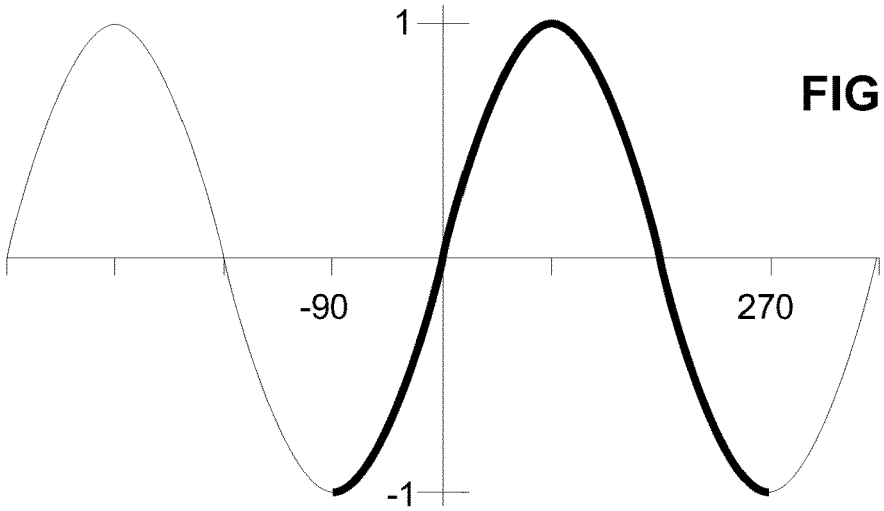
FIG. 15 illustrates an example sine curve.

The rising and falling inflection points represent points in the respective quarter sine curve where the range of change in demand shifts between increasing and decreasing. In the illustrated embodiment, these points are determined in the general manner illustrated in FIGS. 15-17. In particular, FIG. 15 illustrates a generic sine curve, with the portion between −90 degrees and 270 degrees illustrated in bold. It will be appreciated that the bolded portion has a similar profile to the segment of a predicted demand curve between two corners (e.g., the segment between the current and next corner contact angles illustrated in FIG. 13), with the local minimums at −90 and 270 degrees corresponding generally to the contact angles for the current and next corners, and the local maximum at 90 degrees corresponding generally to the peak demand angle between the current and next corners.

In order to fit a curve onto this segment of a demand curve, the rising and falling inflection points may be generated as being half way between the respective corner contact angles and the peak demand angle, with demand values that are the averages of the demand values associated with the respective corner contact angles and peak demand angle.

Figure 16:
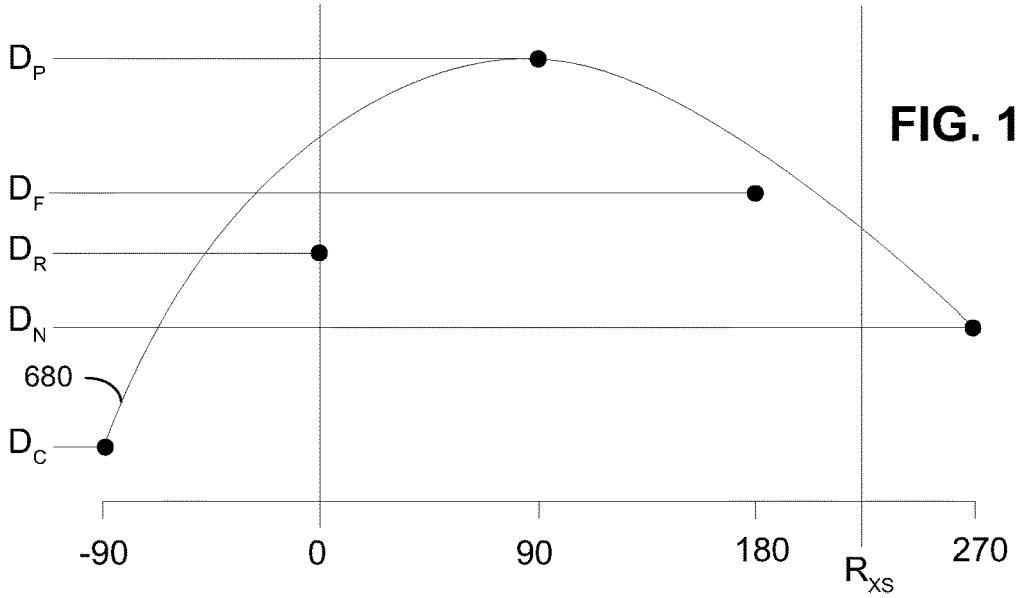
FIG. 16 illustrates a sub-portion of the portion of the demand curve of FIG. 13.

To facilitate an understanding of this concept, for example, FIG. 16 illustrates portion 680 of demand curve 370 horizontally stretched to position the corner contact angle for the current corner at −90 degrees, the corner contact angle for the next corner at 270 degrees, and the peak demand angle at 90 degrees. It will be appreciated that the degree in which portion 680 is stretched between the corner contact angle for the current corner and the peak demand angle may differ from the degree in which portion 680 is stretched between the peak demand angle and the corner contact angle for the next corner. In addition, it will be appreciated that in some embodiments, this "stretching" may be implemented simply through mathematical scaling The rising inflection point is positioned at a 0 degree rotational position (i.e., half way between the −90 degree rotational position for the current corner and the 90 degree rotational position for the peak demand angle) and the falling inflection point is positioned at a 180 degree rotational position (i.e., half way between the 90 degree rotational position for the peak demand angle and the 270 degree rotational position for the next corner). The demand value $D_R$ for the rising inflection point is $(D_P-D_C)/2$ and the demand value $D_F$ for the falling inflection point is $(D_P-D_N)/2$.

Figure 17:
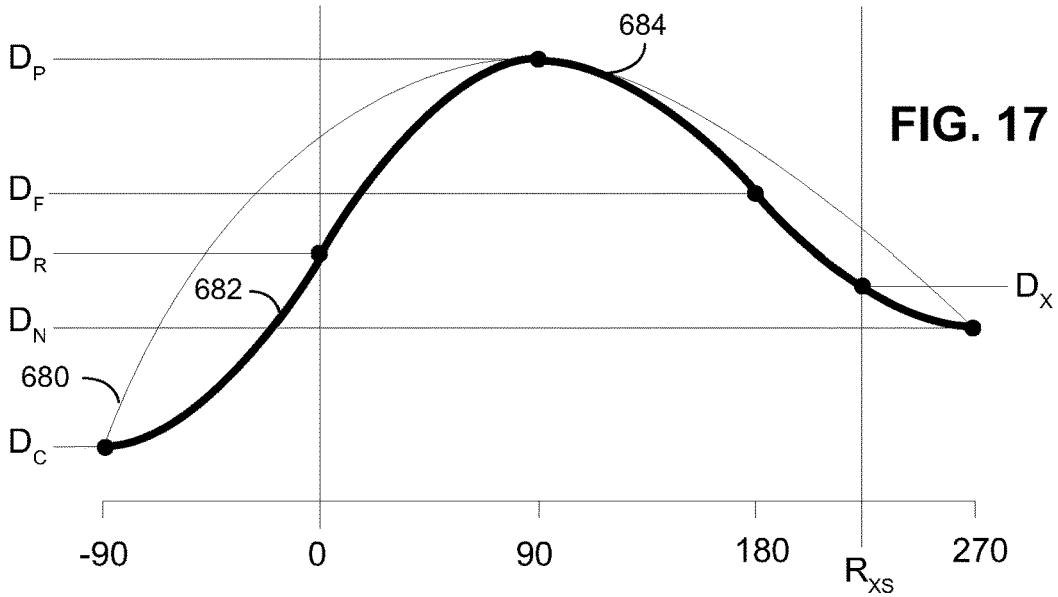
FIG. 17 illustrates a fitted curve superimposed on the sub-portion of FIG. 16.

FIG. 17 illustrates two quarter sine curves or segments 682, 684 respectively fit onto the rising and falling sub-portions of demand curve portion 680. For segment 682, a sinusoidal function (e.g., a sine function) is fit to the point corresponding to the current corner (−90, $D_C$), the rising inflection point (0, $D_R$) and the point corresponding to the peak demand (90, $D_P$), while for segment 684, a sinusoidal function (e.g., a sine function) is fit to the point corresponding to the point corresponding to the peak demand (90, $D_P$), the falling inflection point (0, $D_F$) and the point corresponding to the next corner (−90, $D_N$).

Now returning to FIG. 12, while in some embodiments curve fitting for both the rising and falling sub-portions of a demand curve portion may be performed (e.g., to generate both quarter sine curves 682, 684 of FIG. 17, in the illustrated embodiment, only one of the quarter sine curves may be fit for any particular rotational position. Thus, block 712 effectively determines which of the two quarter sine curves is generated.

As such, if the rotational position is before the peak demand angle, block 712 passes control to block 714 to determine the rising inflection point angle and corresponding demand value, and then to block 716 to fit a quarter sine curve segment (e.g., similar in shape to quarter sine curve 682) between the corner contact angle for the current corner, the rising inflection point and the peak demand angle. Otherwise, block 712 passes control to block 718 to determine the falling inflection point angle and corresponding demand value, and then to block 720 to fit a quarter sine curve segment (e.g., similar in shape to quarter sine curve 684) between the peak demand angle, the rising inflection point and the corner contact angle for the next corner. It will be appreciated that various manners may be used to fit a quarter sine curve to the aforementioned points, as will be apparent to those of ordinary skill having the benefit of the instant disclosure.

Upon completion of either block 716 or block 720, control then passes to block 722, where a demand value for the current rotational position is determined using the fit curve. FIG. 17, for example, illustrates a current rotational position $R_{XS}$ (which corresponds to the current rotational position $R_X$ scaled to the same relative position between peak demand angle $R_P$ and the corner contact angle $R_N$ for the next corner in the 180 degree range between the 90 and 270 degree positions illustrated in FIG. 17). The demand value at that current position is illustrated at $D_X$, the value of quarter sine curve 684 at rotational position $R_{XS}$.

Returning again to FIG. 12, once the demand value is determined in block 722, control passes to block 724 to determine the dispense rate from the determined demand, e.g., by scaling the determined demand by a payout percentage or other wrap force parameter. Control then passes to block 726 to control the packaging material dispenser to output packaging material at the determined dispense rate, whereby sequence 700 is then complete.

Various modifications may be made to sequence 700 in other embodiments. For example, different methodologies may be used to generate rising or falling inflection points, e.g., by using a point on a demand curve at a predetermined rotational position (e.g., half way between a corner contact angle and peak demand angle), or by using a point on a demand curve having a predetermined demand value (e.g., using the average of the demand values for the corner contact angle and the peak demand angle). Additional intermediate points may also be used for curve fitting in some embodiments, and in still other embodiments, other curves or functions, e.g., based on other trigonometric functions, polynomial functions, Gaussian functions, Lorentzian functions, Voigt functions, etc., may be used for curve fitting. Moreover, combinations of functions may be used in some embodiments to generate multiple segments of a curve that cover a portion of a relative revolution, a full relative revolution, or even multiple relative revolutions.

Figure 18:
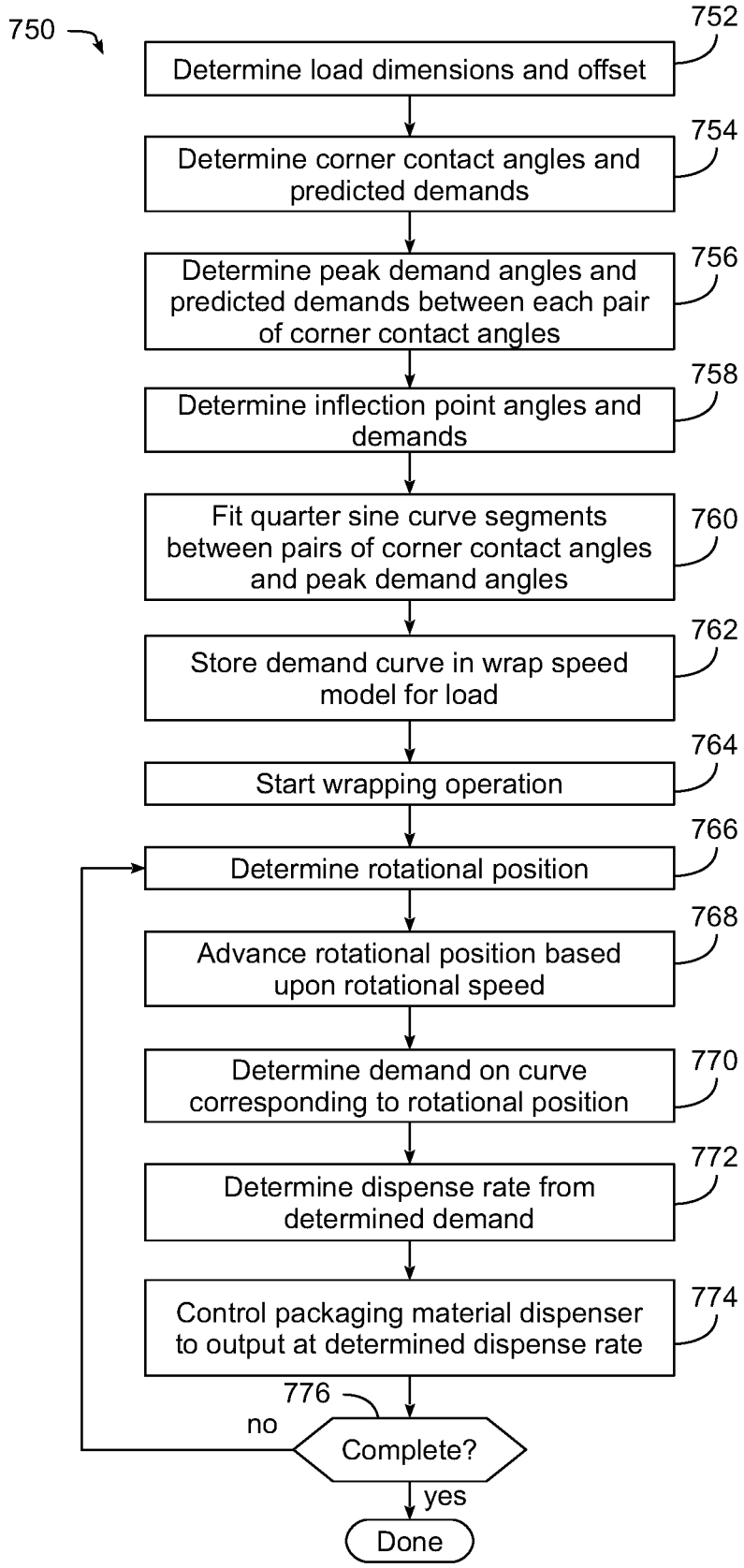
FIG. 18 is a flowchart illustrating another example sequence of operations for determining and controlling a dispense rate of a packaging material dispenser consistent with the invention.

In addition, as illustrated by sequence of operations 750 in FIG. 18, rather than performing curve fitting dynamically during a wrapping operation, curve fitting may be used in some embodiments to generate a demand curve for a load prior to performing a wrapping operation, which may then subsequently be accessed during the wrapping operation to determine a demand for use in generating a dispense rate for a particular rotational position. Sequence 750 begins in block 752 by determining load dimensions and an offset for a load, e.g., based upon input data or using one or more sensors configured to sense a load when being conveyed to a wrapping machine or when the load is ready to be wrapped.

Next, in block 754 corner contact angles and associated predicted demands are determined for all four corners. In some embodiments, the dimensions may also vary at different heights of the load, whereby different predicted demands may be determined for different heights of the load. Predicted demands may be determined in any of the various manners described above.

Next, in block 756 peak demand angles and predicted demands therefor are determined between each pair of corners of the load, e.g., in the various manners discussed above, resulting in the generation of four peak demand angles and associated predicted demands. Likewise, in block 758, four rising inflection points and four falling inflection points, and associated demands therefor, are determined using any of the various manners discussed above.

Next, in block 760, quarter sine curve segments are fit between pairs of corner contact angles and peak demand angles (generating a total of eight quarter sine curve segments) using any of the various manners discussed above, and the resulting demand curve is stored in a wrap speed model for the load in block 762.

Next, in block 764, the wrapping operation is started, and a loop is initiated in block 766 to control dispense rate during the wrapping operation. In block 766, the current rotational position for the load is determined, and in block 768 the rotational position is optionally advanced based upon current rotational speed to offset system lag. Block 770 then determines a demand for the current rotational position by accessing the stored demand curve in the wrap speed model, and indexed based upon the current rotational position (optionally advanced to offset system lag). Next, in block 772, the dispense rate is determined from the demand, e.g., by scaling using payout percentage or another wrap force parameter, and in block 774, the packaging material dispenser is controlled to output at the determined dispense rate. Block 776 then determines if wrapping is complete, and if not, returns control to block 766 to update the dispense rate for the next sensed rotational position of the load. Once wrapping is complete, however, block 776 terminates the sequence.

It will be appreciated that each of blocks 752-776 may be performed in various embodiments by a wrapping apparatus controller, by a cloud service, by a remote server, or by another external device. In other embodiments, however, various blocks may be implemented in different devices. For example, in one embodiment, blocks 752-762 may be performed externally from a wrapping apparatus controller to generate the wrap speed model, and blocks 764-776 may be performed by a wrapping apparatus controller during a wrapping operation to retrieve demand values from a predetermined demand curve stored in the wrap speed model.

Figure 19:
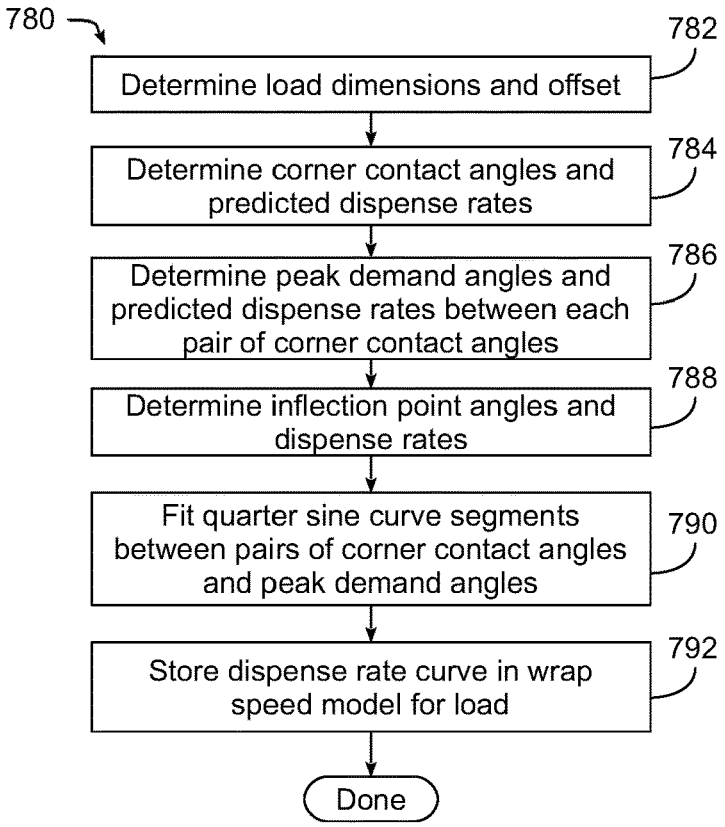
FIG. 19 is a flowchart illustrating an example sequence of operations for creating a wrap speed model consistent with the invention.

As another alternative, as illustrated by sequence of operations 780 in FIG. 19, rather than generating a demand curve using a curve fitting operation as is performed in sequences 700 and 750, it may be desirable in other embodiments to apply curve fitting to a dispense rate curve. Blocks 782-792 of sequence 780, for example, may be used as an alternative to blocks 752-762 of sequence 750 to generate a dispense rate curve. Block 782, for example, may determine load dimensions and an offset for a load, e.g., based upon input data or using one or more sensors configured to sense a load when being conveyed to a wrapping machine or when the load is ready to be wrapped. Next, in block 784 corner contact angles and associated predicted dispense rates may be determined for all four corners, e.g., by determining predicted demands and scaling the predicted demands by a payout percentage or other wrap force parameter to be used when wrapping the load.

Next, in block 786 peak demand angles and predicted dispense rates therefor may be determined between each pair of corners of the load, e.g., by scaling predicted demands determined in any of the various manners discussed above, resulting in the generation of four peak demand angles and associated dispense rates. Likewise, in block 788, four rising inflection points and four falling inflection points, and associated dispense rates therefor, may be determined using any of the various manners discussed above.

Next, in block 790, quarter sine curve segments may be fit between pairs of corner contact angles and peak demand angles (generating a total of eight quarter sine curve segments) using any of the various manners discussed above, and the resulting dispense rate curve may be stored in a wrap speed model for the load in block 762. As such, during a wrapping operation, rather than retrieving demand values from the wrap speed model and scaling based upon a wrap force parameter, dispense rate values may be retrieved directly from the wrap speed model and used to control the dispense rate of a packaging material dispenser. It will also be appreciated that the dynamic determination of dispense rate, e.g., as performed in sequence 700 of FIG. 12, may also utilize a dispense rate curve, so in some embodiments the points to which a curve segment is fit may be based upon dispense rate instead of demand.

Figure 20:
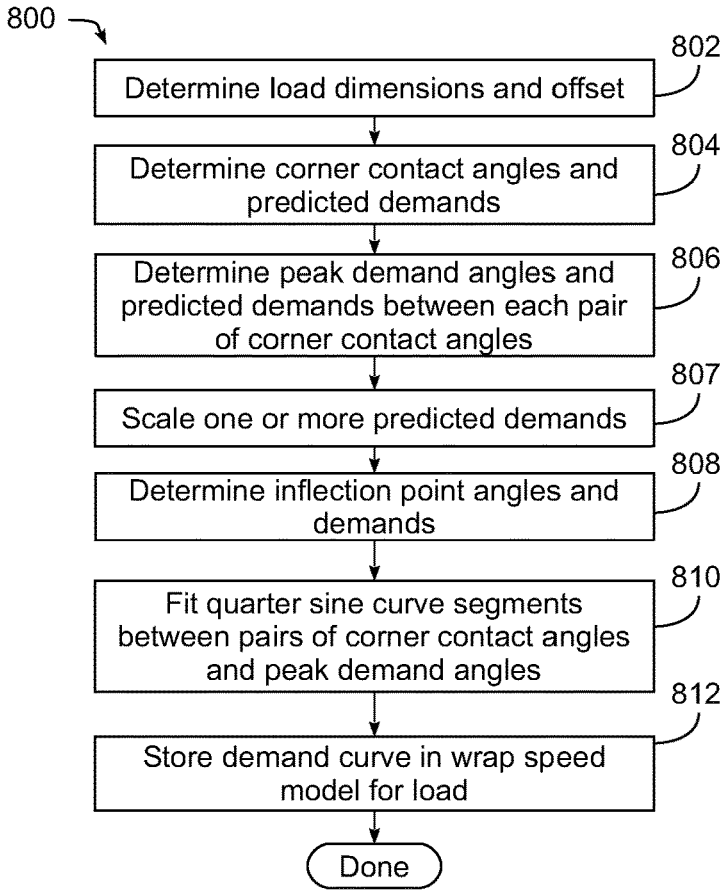
FIG. 20 is a flowchart illustrating another example sequence of operations for creating a wrap speed model consistent with the invention.

As yet another alternative, and as illustrated by sequence of operations 800 in FIG. 20, it may be desirable in some embodiments to scale predicted demands for one or more points utilized in a curve fitting operation. In particular, in some embodiments, it may be desirable to decrease the amplitude of a fit curve to "soften" the curve and reduce the total dispense rate change required for a packaging material dispenser. Blocks 802, 804, 806, 808, 810 and 812, for example, are identical to blocks 752, 754, 756, 758, 760 and 762 of sequence 750 of FIG. 18, but in sequence 800, an additional operation in block 807 may be used to scale one or more predicted demands prior to determining inflection points and fitting quarter sine curve segments for a demand curve. It will also be appreciated that such scaling may also be performed on a dispense rate curve in other embodiments.

Figure 21:
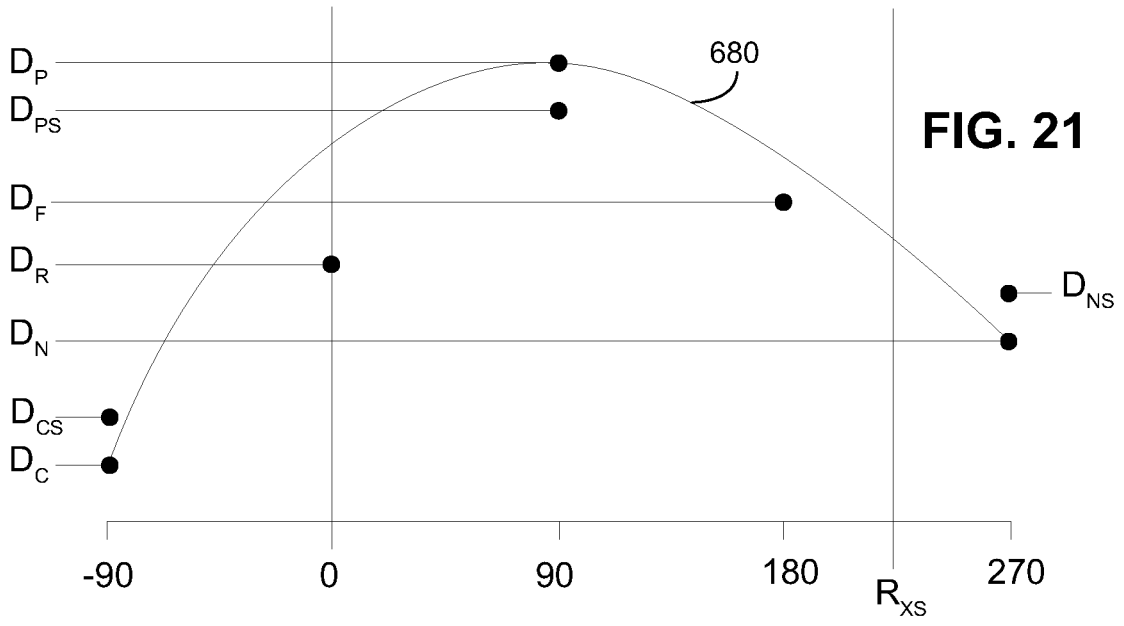
FIG. 21 illustrates the sub-portion of the demand curve of FIG. 16, with additional scaled demand values superimposed thereon.

Predicted demands may be scaled, for example, for one or more corner contact angles, one or more peak demand angles, one or more inflection points, etc., and the scaling may be used to increase or decrease the magnitude of the predicted demand. FIG. 21, for example, illustrates demand curve 680 in a similar manner as FIG. 16, but also illustrates additional scaled predicted demands for the current corner ($D_{CS}$), the next corner ($D_{NS}$) and the peak demand angle ($D_{PS}$). In this embodiment, the predicted demands for the corner contact angles are increased by X % and the predicted demand for the peak demand angle is decreased by X %, although it will be appreciated that different percentages may be used for each angle in other embodiments. In still other embodiments, only a subset of the predicted demands may be scaled, and in some embodiments, scaling may be performed via adding or subtracting a fixed offset rather than scaling by a percentage. In addition, while due to the fact that the same scaling is performed for all three angles illustrated in FIG. 21, the demand values for the inflection points do not change, in other embodiments the scaling of predicted demands may result in different demand values for the inflection points.

Figure 22:
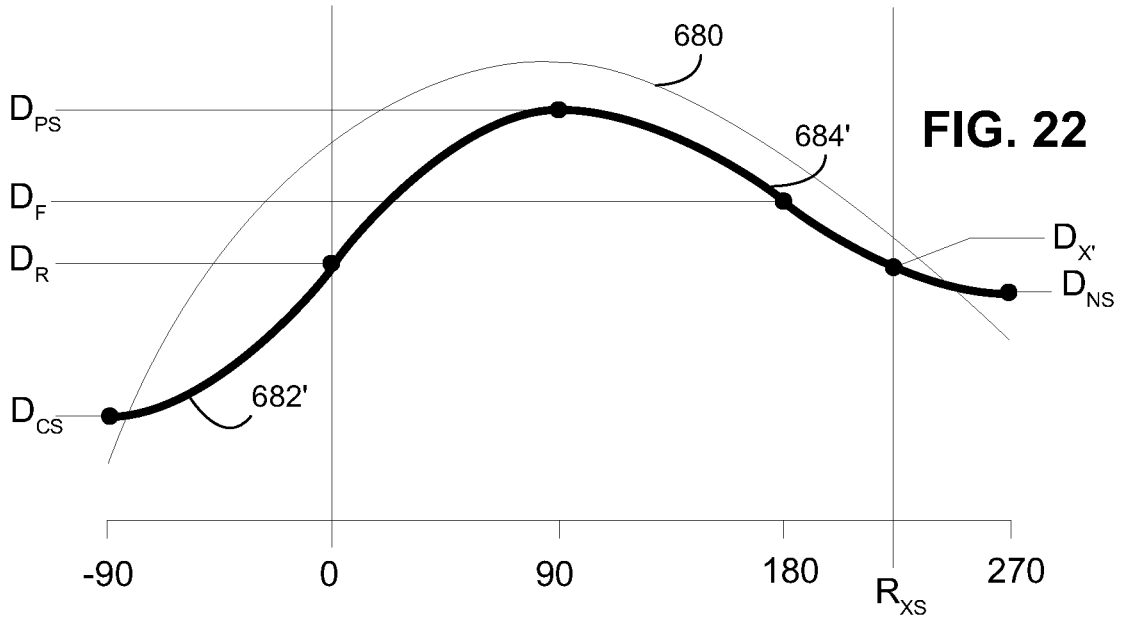
FIG. 22 illustrates a fitted curve superimposed on the sub-portion of FIG. 21.

FIG. 22 illustrates two quarter sine wave curve segments 682' and 684' that may be generated using the scaled predicted demands. As will be appreciated from a review of this figure as compared to FIG. 17, the magnitudes between the peaks and troughs of the fit curve segments 682' and 684' are smaller than for segments 682 and 684, resulting the packaging material dispenser varying within a reduced range of dispense rates. In addition, it will be appreciated that for the rotational angle represented by $R_{XS}$ the demand value output for controlling the packaging material dispenser (e.g., in the manner described above in connection with sequence 700) will shift to the demand value $D_{X'}$ relative to the demand value $D_X$ of FIG. 17.

It will be appreciated that scaled predicted demands may be utilized in connection with other manners of controlling dispense rate, e.g., sequences 700 or 780, among others. Further, other types of curves may be fit using scaled predicted demands in other embodiments.

The curve fitting utilized in the herein-described embodiments may be used in various manners to optimize the wrapping of a load. For example, in some embodiments it may be desirable to fit a curve that effectively decreases a rate of change in dispense rate relative to a dispense rate calculated based on predicted demand when the packaging material dispenser is transitioning between acceleration and deceleration. In some embodiments, it may also be desirable to do so proximate the corners of a load where changes in demand can be substantial once a next corner engages a web of packaging material.

Other embodiments will be apparent to those skilled in the art from consideration of the specification and practice of the present invention. Therefore the invention lies in the claims set forth hereinafter.

What is claimed is:

1. An apparatus for wrapping a load with packaging material, the apparatus comprising:

a packaging material dispenser for dispensing packaging material to the load;

a rotational drive configured to generate relative rotation between the packaging material dispenser and the load about a center of rotation; and a controller coupled to the packaging material dispenser and the rotational drive and configured to control the packaging material dispenser during the relative rotation to dispense at a first dispense rate at a first rotational position about the center of rotation, wherein the first dispense rate at which the controller controls the packaging material dispenser at the first rotational position is determined using a curve fit between second and third rotational positions that are respectively before and after the first rotational position about the center of rotation and for which predicted demands are determined.

2. The apparatus of claim 1, wherein the curve is a demand curve defining a demand at each of a plurality of rotational positions between the second and third rotational positions.

3. The apparatus of claim 2, wherein the first dispense rate is determined by scaling a demand from the demand curve based upon a wrap force parameter.

4. The apparatus of claim 1, wherein the curve is a dispense rate curve defining a dispense rate at each of a plurality of rotational positions between the second and third rotational positions, wherein the dispense rate at the second rotational position is determined by scaling the predicted demand at the second rotational position by a wrap force parameter, and wherein the dispense rate at the third rotational position is determined by scaling the predicted demand at the third rotational position by the wrap force parameter.

5. The apparatus of claim 1, wherein the curve includes a portion of a sinusoidal curve fit between the second and third rotational positions.

6. The apparatus of claim 1, wherein the first dispense rate at the first rotational position is further determined by applying a rotational data shift to offset system lag.

7. The apparatus of claim 6, wherein the rotational data shift is variable based upon a rotational drive speed.

8. The apparatus of claim 6, wherein the rotational data shift is applied by rotationally shifting a sensed rotational position of the load.

9. The apparatus of claim 6, wherein the rotational data shift is applied by rotationally shifting the curve.

10. The apparatus of claim 1, wherein the predicted demand at the second rotational position is determined based upon a geometric relationship between the packaging material dispenser and a location of a corner of the load within a plane perpendicular to the center of rotation.

11. The apparatus of claim 10, wherein the predicted demand at the second rotational position is determined based upon a rotation angle about the center of rotation and associated with the corner of the load.

12. The apparatus of claim 11, wherein the rotation angle is a corner location angle.

13. The apparatus of claim 11, wherein the rotation angle is a corner contact angle representing an angle at which packaging material first comes into contact with the corner during the relative rotation between the load and the packaging material dispenser.

14. The apparatus of claim 1, wherein the predicted demand at the second rotational position is determined based upon a sensed tension in a web of packaging material extending between the packaging material dispenser and a corner of the load.

15. The apparatus of claim 1, wherein the second rotational position is a corner contact angle representing an angle at which packaging material first comes into contact with a corner of the load during the relative rotation between the load and the packaging material dispenser.

16. The apparatus of claim 1, wherein the second rotational position is a rotational position associated with a local minimum in demand.

17. The apparatus of claim 1, wherein the second rotational position is a rotational position associated with a local maximum in demand.

18. The apparatus of claim 17, wherein the second rotational position is a rotational position where a corner radial for a corner of the load forms about a 90 degree angle with a web of packaging material extending between the packaging material dispenser and the corner of the load.

19. The apparatus of claim 1, wherein the second and third rotational positions are rotational positions respectively before and after the first rotational position about the center of rotation, wherein a fourth rotational position is a corner contact angle, and wherein the curve is fit between the second, third and fourth rotational positions.

20. The apparatus of claim 1, wherein the second rotational position is a rotational position associated with a local minimum in demand, wherein the third rotational position is a rotational position associated with a local maximum in demand, wherein a fourth rotational position is associated with a rising inflection point having a demand value calculated from an average of the local minimum in demand and the local maximum in demand, and wherein the curve includes a quarter sine curve segment fit between the second, third and fourth rotational positions.

21. The apparatus of claim 1, wherein the second rotational position is a rotational position associated with a local maximum in demand, wherein the third rotational position is a rotational position associated with a local minimum in demand, wherein a fourth rotational position is associated with a falling inflection point having a demand value calculated from an average of the local maximum in demand and the local minimum in demand, and wherein the curve includes a quarter sine curve segment fit between the second, third and fourth rotational positions.

22. The apparatus of claim 1, wherein the second rotational position is a corner contact angle for a current corner, wherein the third rotational position is a rotational position associated with a local maximum in demand between the corner contact angle for the current corner and a corner contact angle for a next corner, wherein a fourth rotational position is associated with a rising inflection point having a demand value calculated from an average of the determined predicted demand for the corner contact angle for the current corner and the local maximum in demand, and wherein the curve includes a quarter sine curve segment fit between the second, third and fourth rotational positions.

23. The apparatus of claim 1, wherein the second rotational position is a rotational position associated with a local maximum in demand, wherein the third rotational position is a corner contact angle for a next corner, wherein a fourth rotational position is associated with a falling inflection point having a demand value calculated from an average of the local maximum in demand and the determined predicted demand for the corner contact angle for the next corner, and wherein the curve includes a quarter sine curve segment fit between the second, third and fourth rotational positions.

24. The apparatus of claim 1, wherein the curve decreases a rate of change in dispense rate relative to a dispense rate calculated based on predicted demand when the packaging material dispenser is transitioning between acceleration and deceleration.

25. The apparatus of claim 1, wherein the curve decreases a rate of change in dispense rate relative to a dispense rate calculated based on predicted demand when the packaging material dispenser is transitioning between acceleration and deceleration proximate a corner of the load.

26. The apparatus of claim 1, wherein the curve includes a plurality of segments spanning a full revolution about the center of rotation, each segment fit between two or more rotational positions for which predicted demands are determined.

27. The apparatus of claim 26, wherein each segment includes a portion of a sinusoidal curve fit between two or more rotational positions for which predicted demands are determined.

28. The apparatus of claim 26, wherein the plurality of segments includes eight segments, each of the eight segments spanning between a rotational position associated with a local minimum in demand and a rotational position associated with a local maximum in demand.

29. The apparatus of claim 1, wherein the curve includes a quarter sine curve segment fit between the second and third rotational positions.

30. The apparatus of claim 1, wherein the curve is fit using values determined for each of the second and third rotational positions using the respective predicted demands determined for the second and third rotational positions.

31. The apparatus of claim 30, wherein the values for each of the second and third rotational positions are equal to the respective predicted demands determined for the second and third rotational positions.

32. The apparatus of claim 30, wherein the value for the second rotational position is scaled relative to the predicted demand determined for the second rotational position.

33. The apparatus of claim 32, wherein the value for the second rotational position is scaled using a wrap force parameter.

34. The apparatus of claim 32, wherein the value for the second rotational position is scaled such that the dispense rate of the packaging material dispenser varies within a reduced range of dispense rates.

35. The apparatus of claim 1, wherein the controller is configured to determine the first dispense rate.

36. The apparatus of claim 35, wherein the controller is further configured to determine a first demand for the first rotational position using the curve and determine the first dispense rate by scaling the determined first demand.

37. The apparatus of claim 35, wherein the controller is configured to receive a first demand for the first rotational position from an external device in communication with the controller, and wherein the controller is configured to determine the first dispense rate by scaling the first demand.

38. The apparatus of claim 1, wherein the controller is configured to receive the first dispense rate from an external device in communication with the controller and configured to determine the first dispense rate.

39. A method of wrapping a load with packaging material using a wrapping apparatus of the type including a packaging material dispenser for dispensing packaging material to the load, the method comprising:

generating relative rotation between the packaging material dispenser and the load about a center of rotation; and controlling the packaging material dispenser during the relative rotation to dispense at a first dispense rate at a first rotational position about the center of rotation, wherein the first dispense rate is determined using a curve fit between second and third rotational positions that are respectively before and after the first rotational position about the center of rotation and for which predicted demands are determined.

40. An apparatus for wrapping a load with packaging material, the apparatus comprising:

a packaging material dispenser for dispensing packaging material to the load;

a rotational drive configured to generate relative rotation between the packaging material dispenser and the load about a center of rotation; and a controller coupled to the packaging material dispenser and the rotational drive and configured to control the packaging material dispenser during the relative rotation to dispense at a first dispense rate at a first rotational position about the center of rotation, wherein the first dispense rate at which the controller controls the packaging material dispenser at the first rotational position is determined using a portion of a sinusoidal curve fit between second and third rotational positions that are respectively before and after the first rotational position about the center of rotation.

41. The apparatus of claim 40, wherein each of the second and third rotational positions is a rotational position associated with a local minimum or maximum in demand.

42. The apparatus of claim 41, wherein the portion of the sinusoidal curve is a quarter sine wave segment.

43. The apparatus of claim 42, wherein a fourth rotational position is associated with an inflection point having a first value calculated from an average of a second value for the second rotational position and a third value for the third rotational position, and wherein the portion of the sinusoidal curve is further fit to the fourth rotational position.

44. The apparatus of claim 43, wherein the second value equals a predicted demand at the second rotational position and the third value equals a predicted demand at the third rotational position.

45. The apparatus of claim 43, wherein the second value is scaled relative to a predicted demand determined for the second rotational position.

46. The apparatus of claim 45, wherein the second value is scaled using a wrap force parameter.

47. The apparatus of claim 45, wherein the second value is scaled such that the dispense rate of the packaging material dispenser varies within a reduced range of dispense rates.

* * * * *